US006480217B1

(12) United States Patent
Inoue et al.

(10) Patent No.: US 6,480,217 B1
(45) Date of Patent: Nov. 12, 2002

(54) PRINTED MATTER WHICH HAS ENHANCED APPEARANCE AND WHOSE IMAGE SURFACE HAS UNIFORM GLOSS, PRINTING METHOD USED TO FORM THE PRINTED MATTER, AND PRINTER USED IN THE PRINTING METHOD

(75) Inventors: Yasutoshi Inoue, Iwate-Ken (JP); Jun Sogabe, Osaka-fu (JP); Fumio Uetsuji, Osaka-fu (JP)

(73) Assignees: Alps Electric Co., Ltd., Tokyo (JP); Fujicopian Co., Ltd., Osaka-fu (JP)

( * ) Notice: Subject to any disclaimer, the term of this patent is extended or adjusted under 35 U.S.C. 154(b) by 0 days.

(21) Appl. No.: 09/602,030

(22) Filed: Jun. 23, 2000

(30) Foreign Application Priority Data

Jun. 24, 1999 (JP) ..... 11-177908

(51) Int. Cl.[7] ..... B41J 2/315
(52) U.S. Cl. ..... 347/212
(58) Field of Search ..... 347/212, 213–214, 347/171–172, 206, 207; 400/120.01, 207, 299.1, 438

(56) References Cited

U.S. PATENT DOCUMENTS 5,127,751 A * 7/1992 Kobayashi et al. ..... 400/249
5,609,425 A * 3/1997 Kawano et al. ..... 400/120.01
5,863,138 A * 1/1999 Watanabe et al. ..... 400/208
6,190,069 B1 * 2/2001 Yamaguchi et al. ..... 400/615.2
6,211,895 B1 * 4/2001 Asabe et al. ..... 347/212
6,215,508 B1 * 4/2001 Bryan et al. ..... 347/171

FOREIGN PATENT DOCUMENTS

JP 11-70680 3/1999

* cited by examiner

*Primary Examiner*—Lamson Nguyen
*Assistant Examiner*—K. Feggins
(74) *Attorney, Agent, or Firm*—Brinks Hofer Gilson & Lione

(57) ABSTRACT

There are provided printed matter whose image surface has uniform gloss and whose image formed of ink is of high quality, has enhanced appearance, does not have its left and right sides reversed, and is easy to see; a printing method which allows the printed matter to be easily obtained, and a printer which makes it possible to easily realize the printing method. The image which is a mirror image formed with ink is formed within an image-formation area of a surface of a print medium which is a transparent member. Then, a surface of the image and at least a blank space section within the image-formation area of the print medium are covered with an underlying layer 8 formed with underlying layer ink, after which a surface of the underlying layer is covered with a light-shielding layer formed with light-shielding layer ink.

8 Claims, 10 Drawing Sheets

PRINTED MATTER WHICH HAS ENHANCED APPEARANCE AND WHOSE IMAGE SURFACE HAS UNIFORM GLOSS, PRINTING METHOD USED TO FORM THE PRINTED MATTER, AND PRINTER USED IN THE PRINTING METHOD

BACKGROUND OF THE INVENTION

1. Field of the Invention

The present invention relates to printed matter which has enhanced appearance, which is easy to see, and which has a high-quality image formed thereon, and whose image surface has uniform gloss, a printing method used to form the printed matter, and a printer used in the printing method.

2. Description of the Related Art

In one conventional arrangement printed material has been obtained using a thermal transfer printer and a transparent member, such as a transparent film, used as a print medium in order to print a full-color image on the front surface of the transparent member with ink. It is known that, in such printed material, gloss at the surface of the image becomes uniform, and the appearance of the image becomes enhanced when the image is viewed from the back side opposite to the side of the transparent member where the image is formed than when it is viewed directly.

However, in the above-described conventional printed material obtained by printing the image with ink on the front surface of the transparent member serving as a print medium with the thermal transfer printer, the image formed on the front surface of the transparent member is viewed through the transparent member from the back surface thereof. Therefore, the left and right sides of the image are reversed, so that a normal, or noninverted, image cannot be obtained. In addition, since the image and the transparent member are viewed while light is transmitted therethrough, the image cannot be easily seen. Consequently, in order to make it easier to see the image, it is necessary to carry out a complicated operation, such as bonding a white sheet or applying white paint to the surface of the transparent member where the image is formed. Depending on the paint used, applying white paint to the surface of the transparent member where the image is formed may adversely affect the image. For example, the paint may melt the image. Therefore, printing to a transparent member is currently carried out only in limited applications where it is not necessary to view the image formed with ink through a transparent member from the back surface thereof, such as when an OHP (over-head projector) is used.

SUMMARY OF THE INVENTION

Accordingly, in view of the above-described problems, it is an object of the present invention to provide printed material which has enhanced appearance, which has a high-quality image formed thereon without the left and right sides of the image being reversed, which is easy to see, and whose image surface has uniform gloss, a printing method which allows the printed matter to be easily obtained, and a printer which allows the printing method to be easily realized.

To this end, according to one aspect of the present invention, there is provided printed material wherein an image which is a mirror image formed with image-formation ink is formed within an image-formation area of a surface of a print medium which is a transparent member. A surface of the image and at least a surface of a blank space section within the image-formation area of the print medium is covered with an underlying layer formed with underlying layer ink, and a surface of the underlying layer is coated with a light-shielding layer formed with light-shielding layer ink.

By adopting the above-described structure, the mirror image formed with ink on the surface of the print medium which is a transparent member can be viewed as a normal image without the left and right sides of the image being reversed when viewed through the print medium from the back surface thereof. In addition, the underlying layer and the light-shielding layer are highly capable of shielding the image formed on the surface of the print medium. Therefore, it is easier to view the image through the print medium which is a transparent member from the back surface thereof. Consequently, it is possible to obtain printed matter which has enhanced appearance, which has a high-quality image formed thereon without the left and right sides being reversed, which is easy to see, and whose image surface has uniform gloss when viewed through the print medium from the back side thereof.

The image, the underlying layer, and the light-shielding layer area may each be formed by thermal transfer printing.

By adopting the above-described structure, the thermal transfer printing allows the image which is a mirror image formed with ink, the underlying layer, and the light-shielding layer to be easily formed on the print medium.

When the image, the underlying layer, and the light-shielding layer are each formed by thermal transfer printing, the melt viscosity of the underlying layer ink at 160° C. used to form the underlying layer may be less than the melt viscosity of the image-formation ink at 160° C. used to form the image.

By adopting the above-described structure, the fluidity of the underlying layer ink at 160° C. is high, while the fluidity of the image-formation ink at 160° C. is low, so that the underlying layer can be easily formed without adversely affecting the image formed with ink.

When printed material is such that an image which is a mirror image formed with image-formation ink is formed within an image-formation area of a surface of a print medium which is a transparent member, a surface of the image and at least a surface of a blank space section within the image-formation area of the print medium is covered with an underlying layer formed with underlying layer ink, and a surface of the underlying layer is coated with a light-shielding layer formed with light-shielding layer ink, the underlying layer may be white.

By adopting the above-described structure, the white underlying layer makes the image stand out when it is viewed through the print medium which is a transparent member from the back surface thereof, making it easier to see the image.

When printed material is such that an image which is a mirror image formed with image-formation ink is formed within an image-formation area of a surface of a print medium which is a transparent member, a surface of the image and at least a surface of a blank space section within the image-formation area of the print medium is covered with an underlying layer formed with underlying layer ink, and a surface of the underlying layer is coated with a light-shielding layer formed with light-shielding layer ink, the print medium may be a transparent film or a transparent sheet.

By adopting the above-described structure, the transparent film or the transparent sheet allows the image and the light-shielding layer, or the image, the underlying layer, and the light-shielding layer to be easily formed.

When printed material is such that an image which is a mirror image formed with image-formation ink is formed within an image-formation area of a surface of a print medium which is a transparent member, a surface of the image and at least a surface of a blank space section within the image-formation area of the print medium is covered with an underlying layer formed with underlying layer ink, and a surface of the underlying layer is coated with a light-shielding layer formed with light-shielding layer ink, the light-shielding ink used to form the light-shielding layer may be metallic ink.

By adopting the above-described structure, the image formed with ink can be more properly shielded by the metallic ink, making it possible to see the image more easily when it is viewed through the print medium from the back surface thereof.

When printed material is such that an image which is a mirror image formed with image-formation ink is formed within an image-formation area of a surface of a print medium which is a transparent member, a surface of the image and at least a surface of a blank space section within the image-formation area of the print medium is covered with an underlying layer formed with underlying layer ink, and a surface of the underlying layer is coated with a light-shielding layer formed with light-shielding layer ink, there may be formed a base having the same size as the print medium peelably adhered to a back surface of the print medium, and one image-formation area surrounded by a half-cut section or a plurality of image-formation areas surrounded by corresponding half-cut sections on the print medium, with the half-cut section and the half-cut sections extending from a front surface to the back surface of the print medium.

By adopting the above-described structure, it is possible to easily obtain a piece of printed matter or pieces of printed matter which are smaller than the print medium itself without carrying out a post-processing operation.

According to another aspect of the present invention, there is provided a printing method comprising the steps of:

printing an image which is a mirror image formed with image-formation ink within an image-formation area of a surface of a print medium which is a transparent member;

performing underlying layer printing with underlying layer ink on a surface of the image and at least a surface of a blank space section within the image-formation area of the print medium; and performing light-shielding layer printing with light-shielding layer ink on a surface of the print medium that has been subjected to the underlying layer printing so as to cover the surface of the print medium that has been subjected to the underlying layer printing.

The image, the underlying layer, and the light-shielding layer may be formed by thermal transfer printing.

When the image, the underlying layer, and the light-shielding layer are formed by thermal transfer printing, the melt viscosity of the underlying layer ink at 160° C. used in the underlying layer printing may be less than the melt viscosity of the image-formation ink at 160° C. used in forming the image.

When a printing method comprises the above-described steps, the underlying layer ink used in the underlying layer printing may be white.

When a printing method comprises the above-described steps, the print medium may be a transparent film or a transparent sheet.

When a printing method comprises the above-described steps, the light-shielding layer ink used in the light-shielding layer printing may be metallic ink.

When a printing method comprises the above-described steps, the printing method may further comprise the steps of forming a base having the same size as the print medium peelably adhered to a back surface of the print medium, and forming one image-formation area surrounded by a half-cut section or a plurality of image-formation areas surrounded by corresponding half-cut sections on the print medium, with the half-cut section and the half-cut sections extending from a front surface to the back surface of the print medium.

According to still another aspect of the present invention, there may be provided a printer comprising:

a thermal head including an image-formation ink ribbon, an underlying layer ink ribbon, a light-shielding layer ink ribbon, and a plurality of heating elements disposed in a row; and controlling means for controlling an operation of each of the image-formation ink ribbon, the underlying layer ink ribbon, the light-shielding layer ink ribbon, and the heating elements;

wherein the controlling means is constructed so that, at least during printing, first, the image-formation ink ribbon is selected, and, based on print information, the heating elements of the thermal head are selectively driven in order to thermally transfer image-formation ink of the image-formation ink ribbon within an image-formation area of a print medium, causing an image which is a mirror image formed with ink to be printed, after which, by selecting the underlying layer ink ribbon and driving the heating elements of the thermal head, underlying layer ink is thermally transferred onto a surface of the image on the print medium and at least a surface of a blank space section within the image-formation area of the print medium, causing the surface within the image-formation area of the print medium to be subjected to underlying layer printing in order to cover the surface within the image-formation area of the print medium with the underlying layer ink, after which, by selecting the light-shielding layer ink ribbon and driving the heating elements of the thermal head, light-shielding layer ink is thermally transferred onto the surface of the print medium that has been subjected to the underlying layer printing, causing the surface of the print medium that has been subjected to the underlying layer printing to be subjected to light-shielding layer printing in order to cover the surface of the print medium that has been subjected to the underlying layer printing with the light-shielding layer ink.

The melt viscosity of the underlying layer ink of the underlying layer ink ribbon at 160° C. may be less than the melt viscosity of the image-formation ink of the image-formation ink ribbon at 160° C.

When a printer comprises a thermal head including an image-formation ink ribbon, an underlying layer ink ribbon, a light-shielding layer ink ribbon, and a plurality of heating elements disposed in a row, and controlling means for controlling an operation of each of the image-formation ink ribbon, the underlying layer ink ribbon, the light-shielding layer ink ribbon, and the heating elements, and the controlling means has the above-described structure, the underlying layer ink of the underlying layer ink ribbon may be white.

When a printer comprises a thermal head including an image-formation ink ribbon, an underlying layer ink ribbon, a light-shielding layer ink ribbon, and a plurality of heating elements disposed in a row, and controlling means for-controlling an operation of each of the image-formation ink ribbon, the underlying layer ink ribbon, the light-shielding layer ink ribbon, and the heating elements, and the controlling means has the above-described structure, the print medium may be a transparent film or a transparent sheet.

When a printer comprises a thermal head including an image-formation ink ribbon, an underlying layer ink ribbon, a light-shielding layer ink ribbon, and a plurality of heating elements disposed in a row, and controlling means for controlling an operation of each of the image-formation ink ribbon, the underlying layer ink ribbon, the light-shielding layer ink ribbon, and the heating elements, and the controlling means has the above-described structure, the light-shielding layer ink of the light-shielding layer ink ribbon may be metallic ink.

When a printer comprises a thermal head including an image-formation ink ribbon, an underlying layer ink ribbon, a light-shielding layer ink ribbon, and a plurality of heating elements disposed in a row, and controlling means for controlling an operation of each of the image-formation ink ribbon, the underlying layer ink ribbon, the light-shielding layer ink ribbon, and the heating elements, and the controlling means has the above-described structure, there may be provided a base having the same size as the print medium peelably adhered to a back surface of the print medium, and one image-formation area surrounded by a half-cut section or a plurality of image-formation areas surrounded by corresponding half-cut sections formed on the print medium, with the half-cut section and the half-cut sections extending from a front surface to the back surface of the print medium.

Therefore, by moving the printer of the present invention in accordance with the printing method, it is possible to easily provide the printed matter of the invention which has enhanced appearance, which has a high-quality image formed thereon without the left and right sides of the image being reversed, which is easy to see, and whose image surface has uniform gloss.

DESCRIPTION OF THE PREFERRED EMBODIMENTS

Hereunder, a description of preferred embodiments of the present invention will be given with reference to the drawings.

First, a description of embodiments of the printed material in accordance with the present invention will be given.

Figure 1:
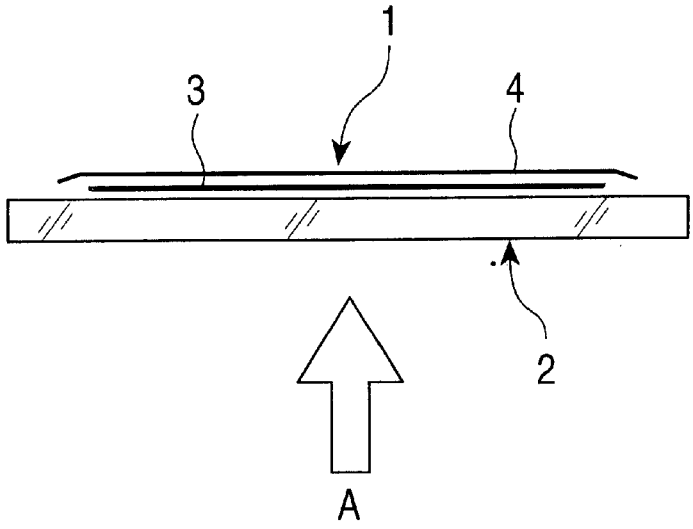
FIG. 1 is a schematic view of the structure of a first embodiment of the printed material in accordance with the present invention.
Figure 2:
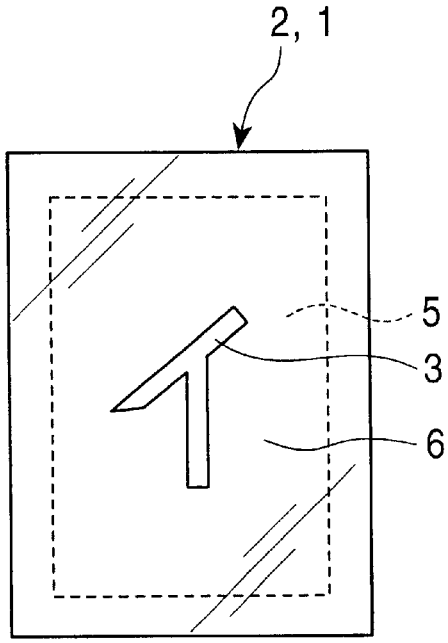
FIG. 2 is a partial reduced plan view of the printed material of FIG. 1, as seen from the back side of a print medium.
Figure 3:
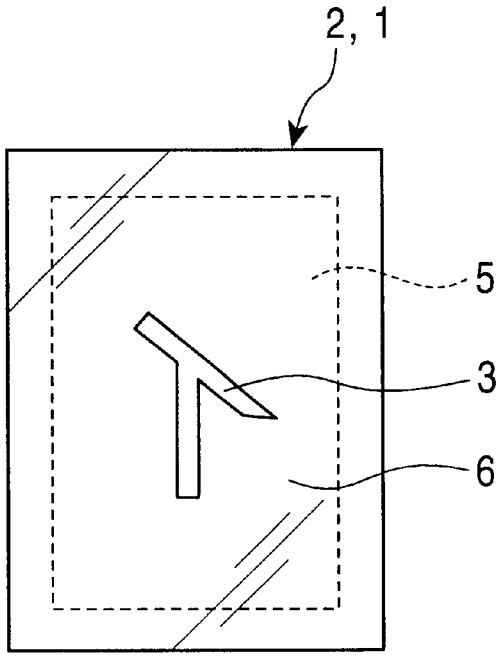
FIG. 3 illustrates an image formed with ink on the printed material of FIG. 1, as seen from the front side of the print medium.

FIGS. 1 to 3 each illustrate a first embodiment of the printed material in accordance with the present invention. More specifically, FIG. 1 is a schematic view illustrating the structure of the printed material. FIG. 2 is a partial plan view of the printed material of FIG. 1, as viewed from the back side of a print medium. FIG. 3 illustrates an image formed with ink on the printed material of FIG. 1, as viewed from the front side of the print medium.

As shown in FIG. 1, in printed material 1 of the embodiment, an image 3 which is a mirror image formed with ink is formed on the front surface of a print medium 2 which is a transparent member. The mirror image has its left and right sides reversed in a direction of a line when it is viewed in a mirror. More specifically, in the embodiment, the image 3 formed on the front surface of the print medium 2 is formed so as to be viewed in the direction of arrow A of FIG. 1, that is, from the back side (that is, the side opposite to the side where the image 3 is formed) of the print medium 2. Therefore, in order for the image 3 to be a normal or noninverted image (like the katakana character shown in FIG. 2) when viewed from the back side of the print medium 2, the image 3 printed on the front surface of the print medium 2 must be a mirror image (like the katakana character shown in FIG. 3) with its left and right sides reversed in the direction of a line when viewed from the front side of the print medium 2. As a result, a mirror image with its left and right sides reversed is formed on the front surface of the print medium 2.

As shown in FIG. 1, a light-shielding layer 4 is formed on the front surface of the image 3 so as to cover it.

A transparent film or a transparent sheet is used as the print medium 2 which is a transparent member in order to make it easier for a printer 21 (described later) to perform a printing operation. In general, the print medium 2 used in the embodiment is cut into a predetermined size, such as into an A4 size.

The image 3 and the light-shielding layer 4 are both printed onto the print medium 2 by the printer 21 (described later). The image 3 which is a mirror image formed with ink is formed within an image-formation area 5 of the front surface, which is one surface, of the print medium 2. The image-formation area 5 is enclosed by broken lines in FIG. 2. On the other hand, the light-shielding layer 4 is formed so as to cover at least the front surface of the image 3. The light-shielding layer 4 is formed so as to cover the front surface of the image 3 and at least the front surface of a blank space section 6 within the image-formation area 5 of the print medium 2. In other words, the light-shielding layer 4 is formed so as to cover at least the entire surface of the image-formation area 5.

The image 3 which is a mirror image formed with ink in the embodiment is a full-color image formed by the printer 21. As described later, it is formed by thermally transferring and placing upon each other three types of image-formation ink of three different colors, such as Y (yellow) ink, M (magenta or purplish red) ink, and C (cyan or greenish blue) ink. It may also be formed by thermally transferring and placing upon each other. four types of image-formation ink of four different colors, such as Y ink, M ink, C ink, and B (black) ink.

Using the printer 21 (described later), the light-shielding layer 4 used in the embodiment is formed by thermally transferring light-shielding layer ink, that is, metallic ink which is silver ink in the embodiment.

A description of the operation of the above-described structure in the embodiment will now be described.

In the printed matter 1 of the embodiment, the image 3 which is a mirror image formed with ink on the front surface of the print medium 2 which is a transparent member is seen as a normal image whose left and right sides are not reversed when viewed in the direction of thick arrow A of FIG. 1, that is, when viewed through the print medium 2 from the back side thereof. The light-shielding layer 4 is highly capable of shielding the image 3 on the front surface of the print medium 2, so that it is possible to make it easier to see the image 3 when it is viewed through the print medium 2 which is a transparent member from the back surface thereof.

Therefore, in the printed matter 1 of the embodiment, when the image 3 is viewed through the print medium 2 from the back side thereof, the surface of the image 3 has uniform gloss, and the image 3 has enhanced appearance, is of high quality, does not have its left and right sides reversed, and is easier to see.

In the printed matter 1 of the embodiment, the print medium 2 which is a transparent film or a transparent sheet allows the image 3 and the light-shielding layer 4 to be easily formed. In other words, the image 3 and the light-shielding layer 4 can be easily printed.

In the printed matter 1 of the embodiment, the light-shielding layer 4 formed using metallic ink can be easily formed on the front surface of the image 3, and is highly capable of shielding the image 3, making it possible to more easily see the image 3 when viewed through the print medium 2 from the back side thereof.

Figure 4:
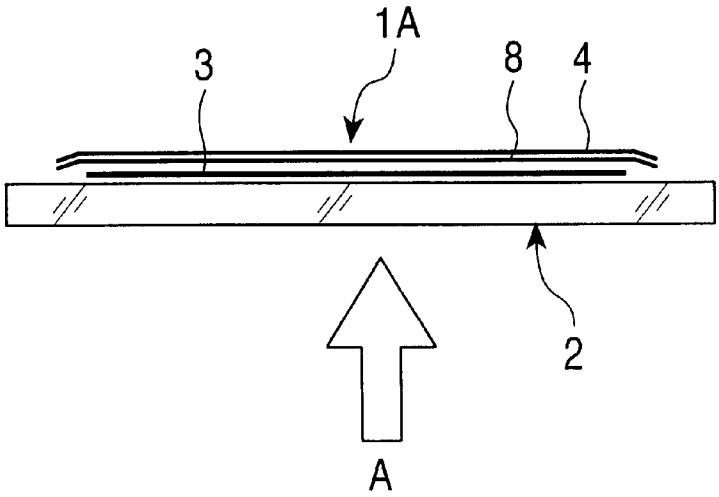
FIG. 4 is a schematic view of the structure of a second embodiment of the printed material in accordance with the present invention.

FIG. 4 illustrates a second embodiment of the printed matter in accordance with the present invention.

As shown in FIG. 4, in printed material 1A of the present embodiment, an image 3 which is a mirror image formed with ink is formed on the front surface of a print medium 2 which is a transparent member. The front surface of the image 3 is covered by an underlying layer 8 which is covered by a light-shielding layer 4.

The image 3, the underlying layer 8, and the light-shielding layer 4 are all printed onto the print medium 2 using a printer 21A (described later). As in the printed material 1 of the above-described first embodiment, the image 3 which is a mirror image formed with ink is formed within an image-formation area 5 (see FIGS. 2 and 3) of the front surface, which is one surface, of the print medium 2. The underlying layer 8 is formed so as to cover the front surface of the image 3 and at least the front surface of a blank space section 6 within the image-formation area 5 of the print medium 2. In other words, it is formed so as to cover at least the entire surface of the image-formation area 5. The light-shielding layer 4 is formed so as to cover at least the entire front surface of the underlying layer 8.

Using the printer 21A (described later), the underlying layer 8 used in the embodiment is formed by thermally transferring white ink used for forming underlying layers. The melt viscosity of the underlying layer ink at 160° C. used to form the underlying layer 8 is lower than the melt viscosity of the image-formation ink at 160° C. used to form the image 3.

The other structure features of the printed matter 1A of the second embodiment are the same as those of the printed matter 1 of the first embodiment.

The printed matter 1A having the above-described structure of the second embodiment provides the same advantages to those of the printed matter 1 of the above-described first embodiment. In addition, the image 3 formed on the front surface of the print medium 2 can be more properly shielded by the underlying layer 8 and the light-shielding layer 4 that function together, so that it is possible to see the image 3 more easily when it is viewed through the print medium 2 which is a transparent member from the back side thereof.

Therefore, in the printed material 1A of the embodiment, when the image 3 is viewed through the print medium 2 from the back side thereof, the surface of the image 3 has uniform gloss, and the image 3 has enhanced appearance, is of high quality, does not have its left and right sides reversed, and is seen more easily.

In the printed matter 1A of the embodiment, the melt viscosity of the underlying layer ink at 160° C. used to form the underlying layer 8 is lower than the melt viscosity of the image-formation ink at 160° C. used to form the image 3, so that, at 160° C., the underlying layer ink has high fluidity, whereas the image-formation ink used has low fluidity. Therefore, when a printing operation is carried out using the printer 21A (described later), the underlying layer 8 can be easily formed without affecting the image 3.

In the printed matter 1A of the embodiment, the white underlying layer 8 causes the image 3 to stand out when it is viewed through the print medium 2 which is a transparent member from the back side thereof, so that it is possible to make it easier to see the image 3.

In the printed material 1A of the embodiment, the print medium 2, which is a transparent film or a transparent sheet, allows the image 3, the underlying layer 8, and the light-shielding layer 4 to be easily formed. In other words, the image 3, the underlying layer 8, and the light-shielding layer 4 can be easily printed using the printer 21A (described later).

In the printed matter 1A of the embodiment, the light-shielding layer 4 formed with metallic ink can be easily formed on the front surface of the underlying layer 8, and can even more properly shield the image 3. Therefore, it is possible to more easily see the image 3 when viewed through the print medium 2 from the back side thereof.

Figure 5:
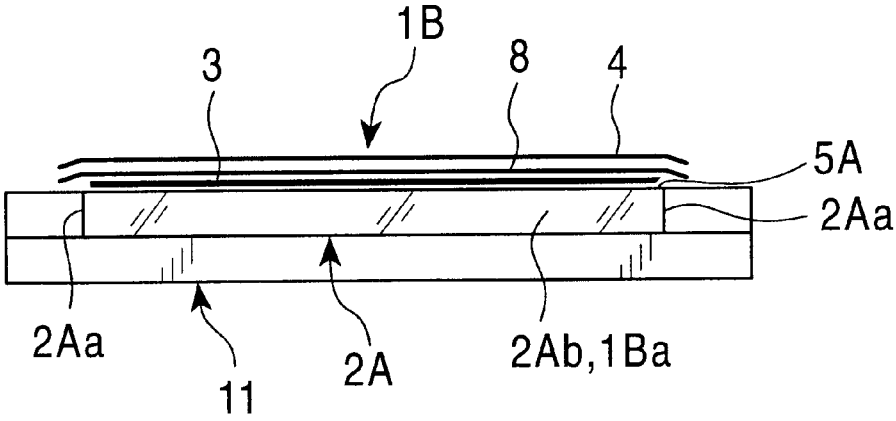
FIG. 5 is a schematic view of the structure of a third embodiment of the printed material in accordance with the present invention.
Figure 6:
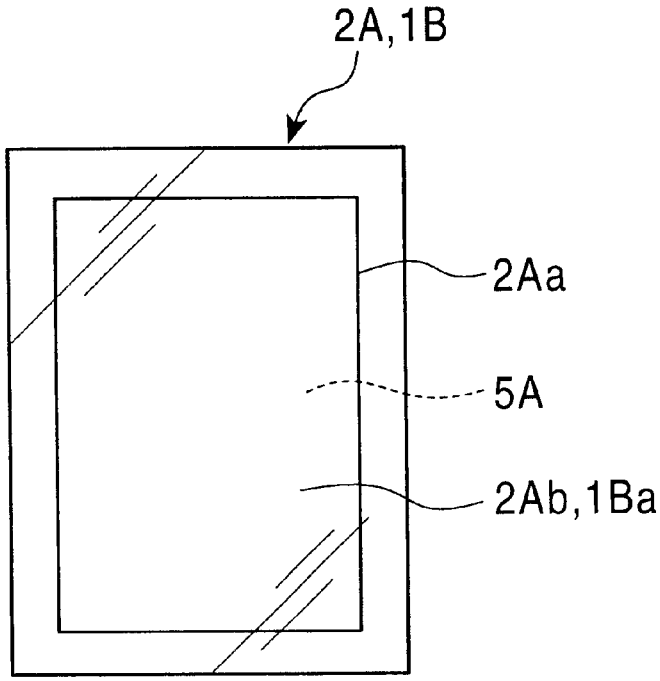
FIG. 6 is a partial reduced plan view of the printed material of FIG. 5, as seen from the front side of a print medium.

FIGS. 5 and 6 each illustrate a third embodiment of the printed matter in accordance with the present invention.

As shown in FIGS. 5 and 6, in printed material 1B of the embodiment, a base 11 which is the same size as a print medium 2A is bonded to the back surface of the print medium 2A so that it can be peeled therefrom, and one image-formation area 5A enclosed by a substantially square half-cut section 2A*a* extending from the front surface to the back surface of the print medium 2A is formed on the print medium 2A. As shown in FIG. 5, an image 3 which is a mirror image formed with ink is formed within the image-formation area 5A. An underlying layer 8 is formed so as to cover the front surface of the image 3 and at least the front surface of a blank space section 6 (see FIG. 3) within the image-formation area 5A of the print medium 2A. In other words, it is formed so as to cover at least the entire surface of the image-formation area 5A. A light-shielding layer 4 is formed so as to cover at least the entire front surface of the underlying layer 8.

Paper, resin film, or various other materials may be used for the base 11.

In addition to being square, the image-formation area 5A enclosed by the half-cut section 2A*a* of FIG. 5 may take various shapes, such as a circular shape, a triangular shape, or a pentagonal shape.

The other structural features are the same as those of the printed material 1A of the above-described second embodiment.

Although, as in the printed material 1A of the above-described second embodiment, the image 3 in the printed matter 1B of the third embodiment is formed within the image-formation area 5A of the print medium 2A, and the front surface of the image 3 is covered by the underlying layer 8 and the light-shielding layer 4, it may be formed, as in the printed material 1 of the above-described first embodiment, within the image-formation area 5A of the print medium 2A with the front surface of the image 3 being covered only by the light-shielding layer 4.

In the printed matter 1B having the above-described structure of the third embodiment, a print medium section 2A*b* formed within the image-formation area 5A enclosed by the half-cut section 2A*a* is peeled from the base 11 in order to make it possible to easily obtain printed matter 1Ba being the same size as the image-formation area 5A but smaller than the print medium 2A itself without performing a post-processing operation.

Figure 7:
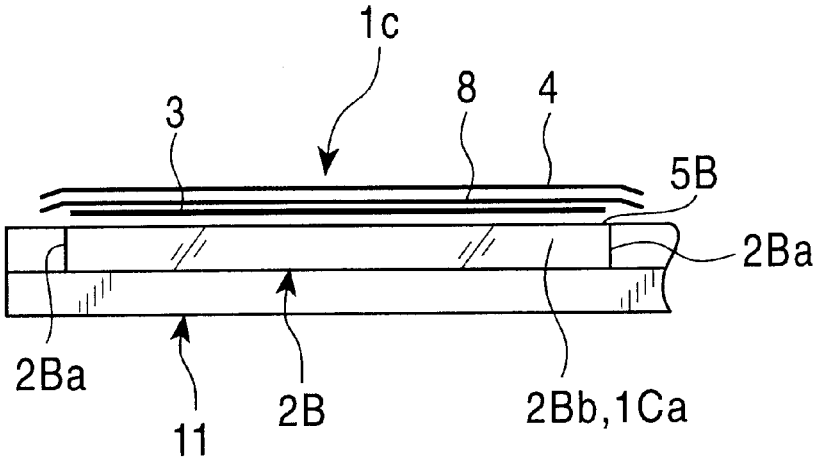
FIG. 7 is a partial schematic view of the structure of a fourth embodiment of the printed material in accordance with the present invention.
Figure 8:
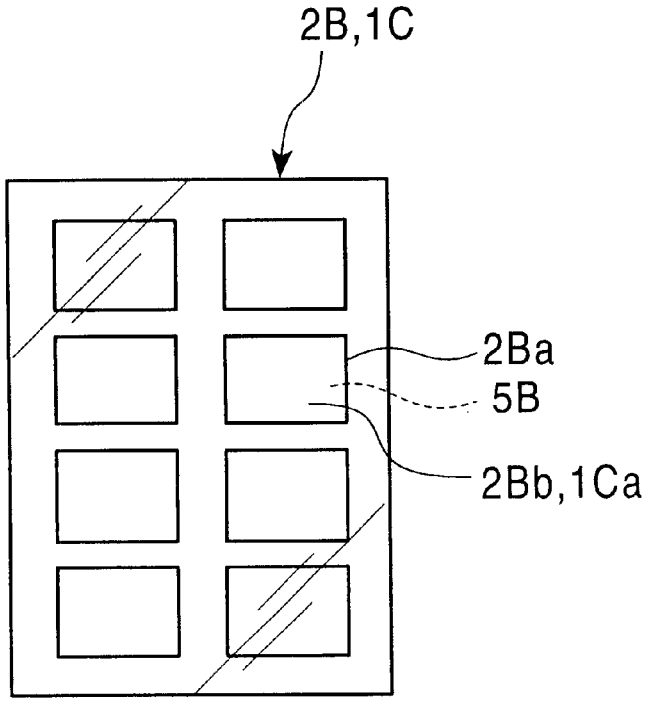
FIG. 8 is a partial reduced plan view of the entire structure of the printed matter of FIG. 7, as seen from the front side of a print medium.

FIGS. 7 and 8 illustrate a fourth embodiment of the printed matter in accordance with the present invention.

As shown in FIGS. 7 and 8, in printed matter 1C of the fourth embodiment, a base 11 which is the same size as a print medium 2B is bonded to the back surface of the print medium 2B so that it can be peeled therefrom. In addition, eight image-formation areas 5B enclosed by corresponding substantially square half-cut sections 2B*a* extending from the front surface to the back surface of the print medium 2B are formed at eight locations of the print medium 2B. As shown in FIG. 7, images 3 which are mirror images formed with ink are formed within their corresponding image-formation areas 5B. An underlying layer 8 is formed so as to cover the front surfaces of the images 3 and at least the front surfaces of blank space sections 6 (see FIG. 3) within the corresponding image-formation areas 5B. In other words, it is formed so as to cover at least the entire surfaces of the image-formation areas 5B. A light-shielding layers 4 is formed so as to cover at least the entire front surface of the underlying layer 8.

The number of image-formation areas 5B can be arbitrarily selected, so that two or more image-formation areas 5B may be used as required based on, for example, a design concept.

The other structural features are the same as those of the printed material 1B of the above-described third embodiment.

Although, as in the printed material 1B of the above-described third embodiment, in the printed material 1C of the fourth embodiment, the images 3 are formed within their corresponding image-formation areas 5B of the print medium 2B, and the front surfaces of the images 3 are covered by the underlying layer 8 and the light-shielding layer 4, they may be formed, as in the printed matter 1 of the above-described first embodiment, within the corresponding image-formation areas 5B of the print medium 2B, with the front surfaces of the images 3 being covered only by the light-shielding layer 4.

The printed matter 1C of the fourth embodiment provides the same advantages to those of the printed material 1B of the above-described third embodiment. Printed media 2B*b* within the corresponding image-formation areas 5B enclosed by their corresponding half-cut sections 2B*a* are peeled from the base 11 in order to make it easier to obtain eight pieces of printed matter 1C*a* being the same size as their corresponding image-formation areas 5B but smaller than the printed medium 2B without carrying out a post-processing operation.

Since eight image-formation areas 5B are provided at eight locations, eight pieces of printed material 1C*a* with identical images or with different images can be formed simultaneously.

Although, in the print medium 2A of the printed material 1B of the third embodiment and in the print medium 2B of the printed material 1C of the fourth embodiment, the small half-cut section 2A*a* and the half-cut sections 2B*a* are previously formed, they may be formed in the following ways. For example, a printer with a half-cut mechanism may be provided to form the half-cut section 2A*a* and the half-cut sections 2B*a* immediately after carrying out printing on the print medium 2A to which the base 11 without the half-cut section 2A*a* is bonded and on the print medium 2B to which the base 11 without the half-cut sections 2B*a* is bonded; or separate devices, such as cutting plotters, may be provided to form the half-cut section 2A*a* and the half-cut sections 2B*a* immediately after performing printing on the print medium 2A to which the base 11 without the half-cut section 2A*a* is bonded and on the print medium 2B to which the base 11 without the half-cut sections 2B*a* is bonded.

A description of the printers of the present invention used in a printing method in accordance with the present invention will now be given.

Figure 9:
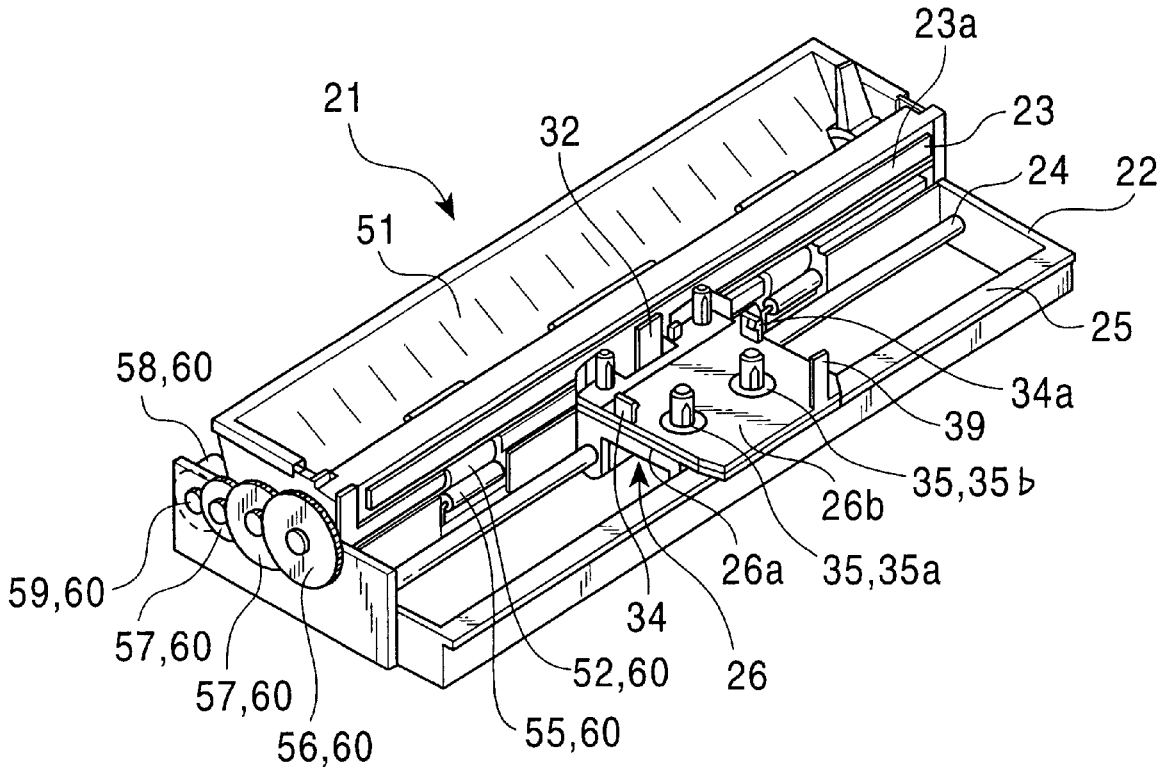
FIG. 9 is a perspective view of the entire structure of the main portion of a first embodiment of the printer in accordance with the present invention used in a printing method of the present invention.
Figure 10:
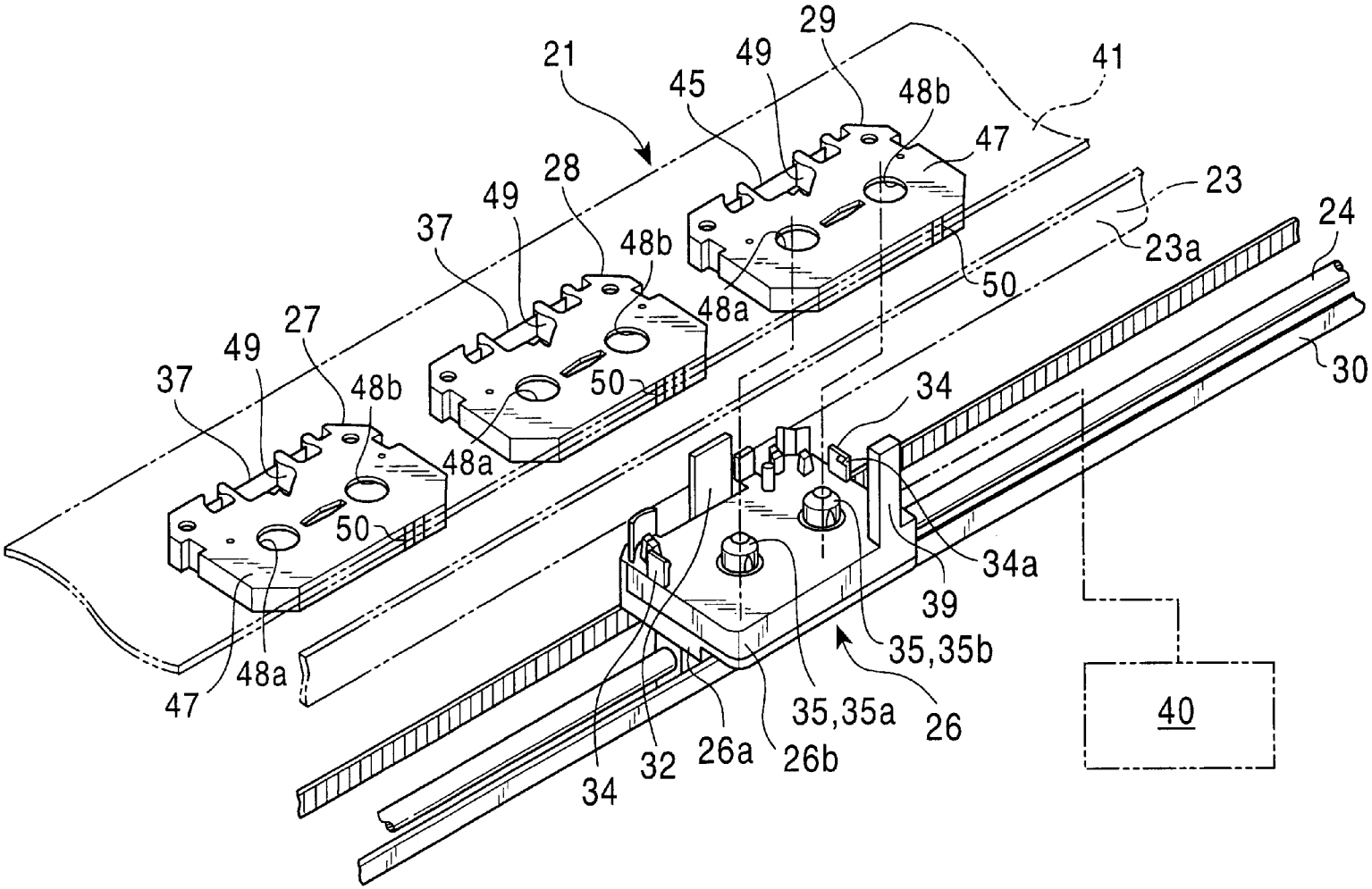
FIG. 10 is an enlarged perspective view of a carriage and component parts around the carriage of the printer of FIG. 9.
Figure 11:
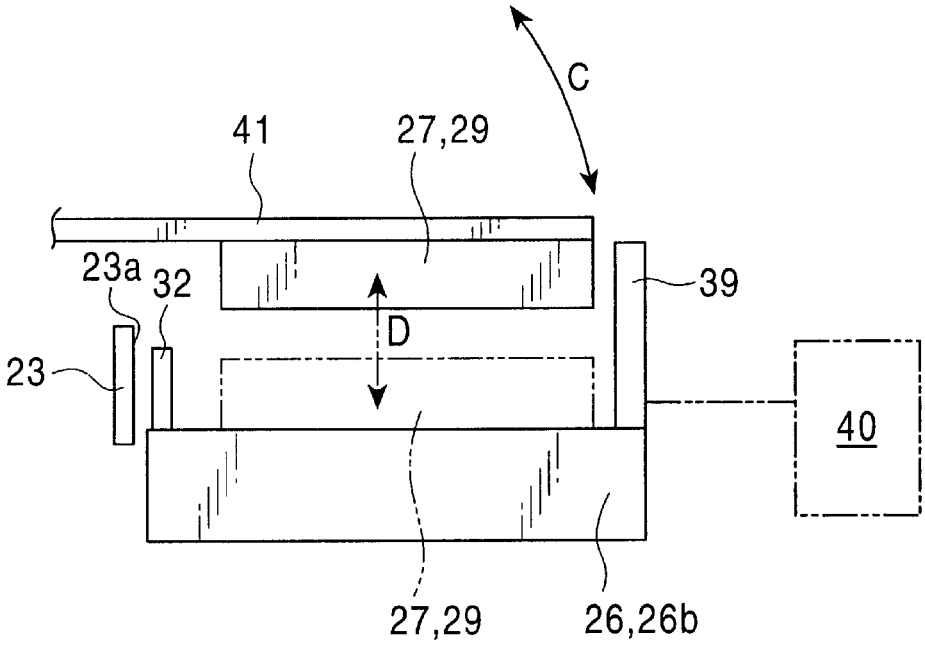
FIG. 11 is a schematic side view of the main portion of the carriage and component parts around the carriage of the printer of FIG. 9.
Figure 12:
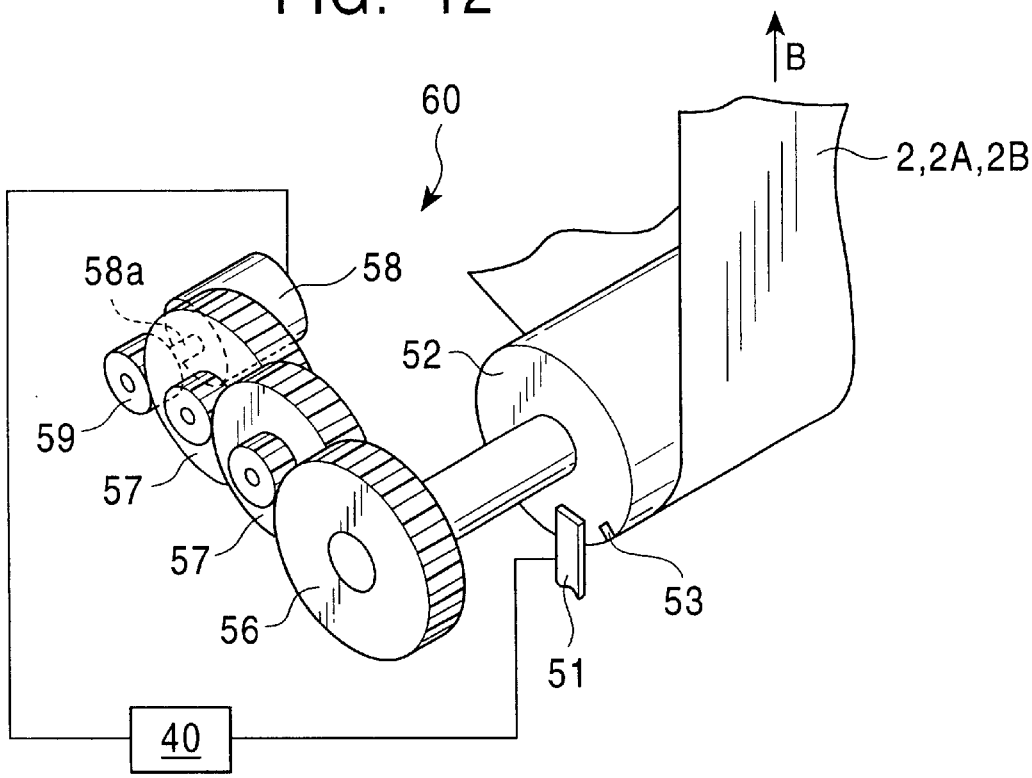
FIG. 12 is an enlarged perspective view of the main portion of a transporting means of the printer of FIG. 9.
Figure 13:
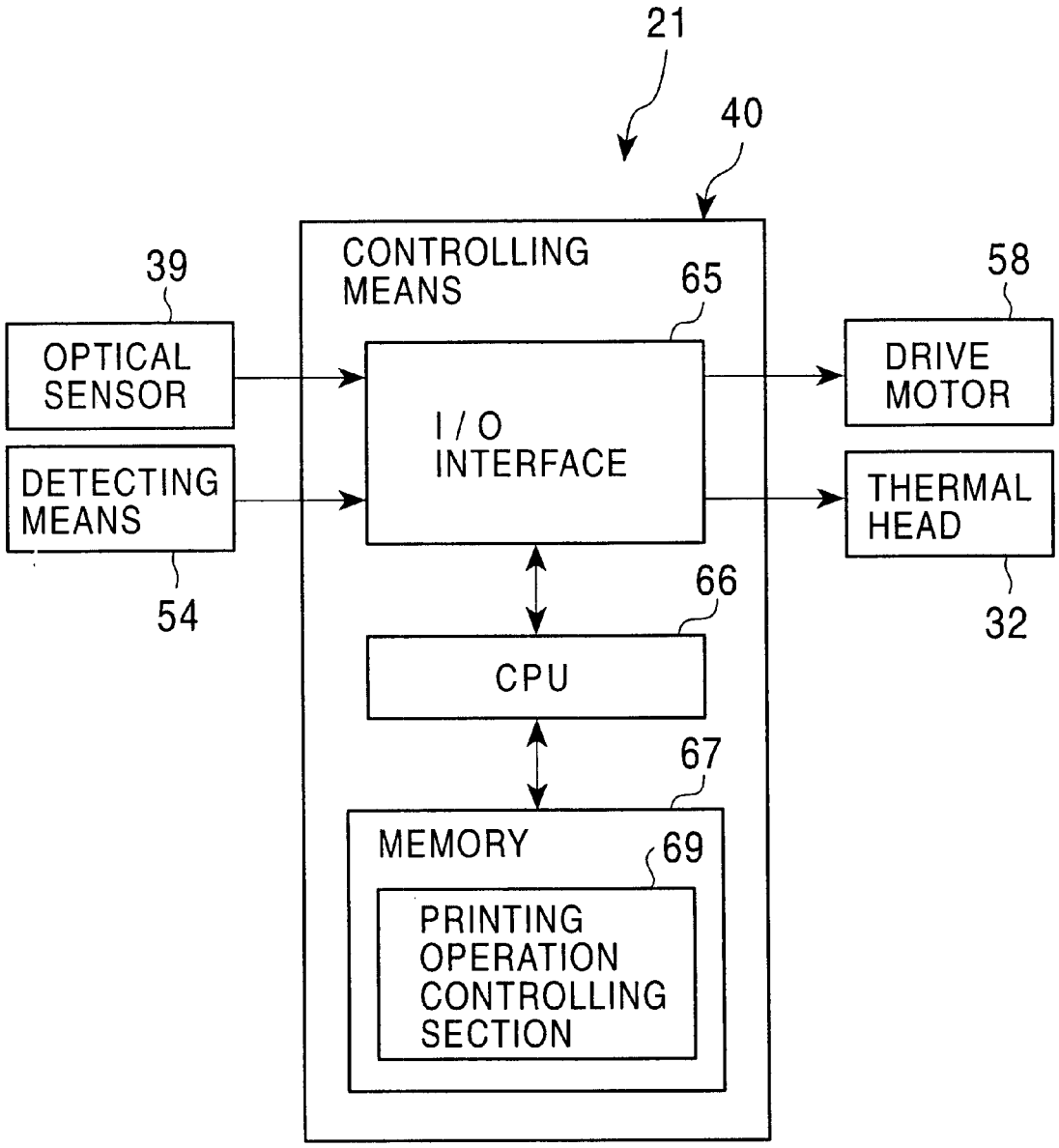
FIG. 13 is a block diagram schematically showing a means for controlling the printer of FIG. 9.

FIGS. 9 to 13 illustrate a first embodiment of the printer of the present invention used in the printing method in accordance with the present invention. More specifically, FIG. 9 is a perspective view of the main portion of the entire structure of the printer. FIG. 10 is an enlarged perspective view of a carriage and portions around the carriage. FIG. 11 is a schematic side view of the main portion of the carriage and the portions around the carriage. FIG. 12 is an enlarged perspective view of the main portion of a transporting means. FIG. 13 is a block diagram schematically illustrating a controlling means.

In the printer of the first embodiment, a total of three types of image-formation ribbon cassettes which accommodate corresponding image-formation ribbons is used to thermally transfer and print a full-color image serving as an image 3 which is a mirror image formed with ink onto a print medium 2 which is a transparent member. The first type of cassette accommodates an image-formation ink ribbon coated with Y (that is, yellow) ink. The second type of cassette accommodates an image-formation ink ribbon coated with M (that is, magenta or purplish red) ink. The third type of cassette accommodates an image-formation ink ribbon coated with C (that is, cyan or greenish blue) ink. After thermally transferring the full-color image, a light-shielding ribbon cassette which accommodates a light-shielding layer ink ribbon coated with light-shielding layer ink is used to thermally transfer the light-shielding layer ink to at least the front surface of the image 3. This causes a light-shielding layer 4 to be formed, whereby the printed matter 1 is obtained.

As shown in FIG. 9, a flat platen 23 is disposed at substantially the center portion of a printer frame 22 of a thermal transfer printer 21 used as the printer of the embodiment so that a print surface 23a thereof is positioned substantially vertically. A guide shaft 24 is disposed forwardly and below and parallel to the platen 23. A flange-shaped guide 25 is formed at the front edge of the printer frame 22, and a carriage 26 is mounted to the guide shaft 24 and the guide 25 so that it can reciprocate along the guide shaft 24 and the guide 25.

As shown in FIG. 10, the carriage 26 used in the embodiment is divided into a top portion and a bottom portion, in which the bottom portion corresponds to a bottom carriage 26*a* mounted to the guide shaft 24, and the top portion corresponds to a top carriage 26*b* onto which any one of image-formation ribbon cassettes 27 or a light-shielding ribbon cassette 29 is placed, the top carriage 26*b* being capable of moving towards and away from the bottom carriage 26*a* in a vertical direction. The carriage 26 is affixed to a portion of a drive belt 30 wound upon a pair of pulleys (not shown). Driving the drive belt 30 using a driving means (not shown), such as a stepping motor, causes the carriage 26 to reciprocate along the guide shaft 24.

As shown in FIGS. 9 and 10, a thermal head 32 is disposed at an end of the carriage 26 so that it opposes the platen 23 and can move towards and away from the platen 23 by a known conventional mechanism (not shown) for moving the head towards and away from the platen 23. A plurality of heating elements (not shown) are disposed in a row at the thermal head 32 along a direction perpendicular to a direction in which the carriage 4 moves, that is, perpendicular to a printing direction or a main scanning direction. In other words, the plurality of heating elements are disposed in a row along a direction in which the print medium 2 is transported, that is, along a subscanning direction (or in the direction of arrow B in FIG. 12). The plurality of heating elements are selectively heated based on predetermined print information input from, for example, a host computer or an image reader, or an input device (not shown), such as a keyboard.

For example, a conventional pair of parallel crank mechanisms (not shown) are disposed on the left and right sides of the carriage 26. The parallel crank mechanisms allow the top carriage 26*b* to move towards and away from and parallel to the bottom carriage 26*a* mounted to the guide shaft 24. For example, a conventional pair of rotary crank mechanisms (not shown) are disposed at the bottom carriage 26*a*. The rotary crank mechanisms allow the top carriage 26*b* to move parallel to the bottom carriage 26*a*.

As shown in FIG. 10, a pair of plate-shaped arms 34 which gently curve inward towards each other are formed at the left and right sides of the top surface of the top carriage 26*b* in a standing manner at an interval substantially equal to the widths of the image-formation ribbon cassettes 27. Projecting engaging sections 34*a* are formed on ends of the corresponding arms 34 so as to oppose each other in order to retain any one of the image-formation ribbon cassettes 27 or the light-shielding ribbon cassette 29. A pair of bobbins 35 are rotatably disposed at the center portion of the top carriage 26*b* so as to be separated by a predetermined interval from each other. The left bobbin in FIG. 9 corresponds to a take-up bobbin 35*a* for taking up any one of the image-formation ink ribbons 37 accommodated in the image-formation ribbon cassettes 27 or the light-shielding layer ink ribbon 45 accommodated in the light-shielding ribbon cassette 29. On the other hand, the right bobbin in FIG. 9 corresponds to a supply bobbin 35*b* for supplying any one of the image-formation ink ribbons 37 or the light-shielding layer ink ribbon 45. When a printing operation is executed, rotationally driving the take-up bobbin 35*a* causes any one of the image-formation ink ribbons 37 or the light-shielding layer ink ribbon 45 to run in a predetermined direction.

A optical sensor 39 is disposed at the top surface of an edge of the carriage 26 distant from the platen 23 in order to detect, for example, the type or color of an image-formation ink ribbon 37 accommodated in the corresponding image-formation ribbon cassette 27. The optical sensor 39 is disposed at a desired portion of the thermal transfer printer 21, and is electrically connected to a controlling means 40 (described later) for controlling the operation of each of the component parts, such as in a printing operation of the thermal transfer printer 21.

As shown in FIGS. 10 and 11, a substantially plate-shaped canopy 41 is disposed above and at a predetermined distance from the carriage 26. It is supported so as to be openable and closable in the directions of a double-headed arrow C in FIG. 11. In the closed state, the canopy 41 functions as a sheet holder at the exit side of a transporting means 42 (described later). The canopy 41 disposed so as to oppose the carriage 26 is substantially the same length as the size of the area of movement of the carriage 26.

A plurality of cassette holders (not shown) are disposed at predetermined locations of the bottom surface of the canopy 41 opposing the carriage 26. The cassette holders allow the three image-formation ribbon cassettes 27 (only two are shown) and the light-shielding ribbon cassette 29 to be disposed in one row along a direction of movement of the carriage 26. As described above, the three image-formation ribbon cassettes 27 separately accommodate the corresponding image-formation ink ribbons 37 that are coated, respectively, with three types of image-formation ink, Y ink, M ink, and C ink, which are at least required to print the full-color image 3 which is a mirror image formed with ink. The light-shielding ribbon cassette 29 accommodates the light-shielding layer ink ribbon 45.

The three image-formation ink ribbons 37 used in the embodiment carry image-formation ink of three colors, Y ink, M ink, and C ink, respectively. The image-formation ink ribbons 37 which carry their respective image-formation ink each comprise a layer including heat-sensitive (a heat-fusible or a heat-hardening) ink used as image-formation ink coated on one surface of a support member, with the other surface of each support member being subjected to heat resistance processing using silicone mixed resin. Each heat-sensitive ink coated layer is a layered structure formed by placing a release layer and a coloring ink layer upon each other in that order from each supporting member side.

For the supporting members, various conventional supporting members used for thermal transfer may be used.

However, considering durability, thermal transmission capability, and costs, it is preferable to use PET (polyethylene terephtalate) films whose thickness fall within a range of from 2 to 6 μm.

The release layers are each formed of a heat-fusible material whose main component is wax. Usable waxes include natural wax, such as haze wax, carnauba wax, candelilla wax, montan wax, and ceresin wax, petroleum wax, such as paraffin wax and microcrystalline wax, synthetic wax, such as ester wax and oxidation wax, and higher fatty acid.

Preferably, each coloring ink layer is formed of thermoplastic resin and a coloring agent. Usable thermoplastic resins include olefin copolymers, such as ethylene-vinyl acetate copolymer, polyamide resin, polyester resin, natural rubber, petroleum resin, rosin resin, and styrene resin. In order to adjust the melt viscosity, various conventional types of waxes used for heat fusion transfer may also be combined. In addition, in order to prevent blocking and contamination, fillers, such as silica, and slip agents, such as silicone oil and fluorine-type surfactants, may also be mixed.

Usable coloring agents include various conventional pigments and dyes. Usable pigments include azo pigment, phthalocyanine pigment, quinacridone pigment, thioindigo pigment, anthraquinone pigment, isoindolin pigment, and carbon black, and a combination of two or more of these pigments.

By causing the heating elements of the thermal head 32 to generate heat, the image-formation ink carried by each of the ink ribbons 37 is thermally transferred onto the print medium 2.

The light-shielding layer ink ribbon 45 used in this embodiment carries metallic silver ink as light-shielding layer ink. The light-shielding layer ink ribbon 45, which carries metallic ink, used in this embodiment includes a layer formed by coating metallic ink on one surface of a supporting member, with the other surface of the supporting member being subjected to heat resistance processing using silicone-mixed resin. The layer formed by coating metallic ink is a layered structure in which a release layer, heat-resistant layer for metal-evaporation (deposition), a metal-evaporated layer, and an adhesive layer are placed upon each other in that order from the supporting member side.

For the supporting member, various conventional supporting members used for heat transfer may be used. However, considering durability, heat transmission capability, and costs, it is preferable to use a PET (polyethyleneterephthalate) film whose thickness falls in a range of from 2 μm to 12 μm.

For the release layer, it is preferable to use various types of waxes or resins having a softening point of 100° C or more and a small adhesive strength with respect to the supporting member. Preferable types of resins having small adhesive strength preferably include thermoplastic resins such as petroleum resin, rosin resin, terpene resin, and styrene resin. Preferable types of waxes include oxidation wax, polyethylene wax, and Fischer-Tropsch wax.

In order to prevent a reduction in the strength with which the supporting member supports the evaporated layer, it is necessary that the release layer be formed thin. Considering transfer ability, it is preferably in a range of from 0.05 to 0.5 μm.

The heat-resistant layer for metal-evaporation is formed to preserve thermal resistance of the supporting member during evaporation and the evaporated layer, and is formed primarily of thermoplastic resin (including thermoplastic elastomer). Usable types of thermoplastic resins include polyester resin, polyamide resin, polyurethane resin, acrylic resin (or methacrylate resin), and ionomer resin. Considering the thermal resistance when the metal-evaporated layer is formed by evaporation, it is preferable that the heat-resistant layer for metal-evaporation have a softening point of 100° C. or more. From the viewpoint of obtaining good thermal transfer ability, it is preferable that the thickness of the heat-resistant layer for metal-evaporation be in a range of from 0.2 to 1.0 μm. If the thickness is made smaller than 0.2 μm, good mechanical strength cannot be obtained, so that the metal-evaporated layer tends to fall apart when a transferring operation is carried out. On the other hand, if the thickness is made larger than 1.0 μm, the printing definition tends to be low.

Although a metal, such as aluminum, zinc, tin, silver, gold, or platinum, may be used to form the metal-evaporated layer, it is, in general, preferable to use aluminum. The metal-evaporated layer is formed by carrying out a physical go: evaporation method, such as vacuum evaporation, sputtering, or ion plating, or a chemical evaporation method. From the viewpoint of obtaining high metallic gloss, the thickness of the metal-evaporated layer is 10 nm to 100 nm, and particularly 20 nm to 40 nm.

The adhesive layer is formed primarily of thermoplastic resin. Usable types of thermoplastic resins include polyester resin, polyamide resin, polyurethane resin, ethylene-vinyl acetate copolymer, rosin resin, and terpene resin. Considering the transfer ability, it is preferable that the softening point of the adhesive layer be in a range of from 50° C. to 120° C. To prevent blocking and contamination, a small amount of particles of slip agent may be added. It is preferable that the thickness of the adhesive layer be in a range of from 0.5 μm to 2.0 μm.

The image-formation ribbon cassettes 27 and the light-shielding ribbon cassette 29 are selectively transferred back and forth between the canopy 41 and the top carriage **26*b* as indicated by a double-headed arrow D in FIG. 11**.

In order to form the full-color image, the following types of cassettes may also be used when required. An image-formation ribbon cassette which accommodates an image-formation ink ribbon coated with B (black) image-formation ink may be used in combination with the other three types of cassettes which accommodate their corresponding image-formation ink ribbons 37 of three colors coated, respectively, with Y ink, M ink, and C ink. Instead of the above-described ribbon cassettes, one image-formation ribbon cassette (not shown) which accommodates an image-formation a-ink ribbon repeatedly coated with three types of image-formation ink of three colors, Y ink, M ink, and C ink, or with four types of image-formation ink of four colors, Y ink, M ink, C ink, and B ink, may be used.

As shown in FIG. 10, case bodies 47 of the image-formation ribbon cassettes 27 and the light-shielding ribbon cassette 29 are all of the same shapes and dimensions. A take-up reel **48*a* and a supply reel 48*b* are rotatably accommodated in each case body 47. The takeup reels 48a take up portions of their corresponding image-formation image ribbons 37 and light-shielding layer ink ribbon 45 subjected to printing as a result of taking up the corresponding image-formation ink ribbons 37 and light-shielding layer ink ribbon 45 thereupon. The supply reels 48*b* are used to supply their corresponding image-formation ink ribbons 37 and light-shielding layer ink ribbon 45. A recess 49 facing the thermal head 32 is formed in a surface of each case body 47 opposing the platen 23 when each case body 47 is loaded on the carriage 26. An intermediate portion of each image-formation ink ribbon 37 or that of the light-shielding layer ink ribbon 45 can be led to the outside at the inner side of its corresponding recess 49. A pair of ribbon advancing rollers (not shown), a plurality of guide rollers (not shown), etc., are rotatably supported in the paths where their corresponding image-formation ink ribbon 37 and light-shielding layer ink ribbon 45 run in their corresponding case bodies 47**.

Identification marks 50 which are, for example, reflective seals with different numbers of nonreflective sections 50*a* are disposed at back surfaces of the case bodies 47 extending parallel to the surfaces of the case bodies 47 where the corresponding recesses 49 are formed. Any one of the identification marks 50 is detected by the optical sensor 39 provided at the carriage 26. The detection signal is output to the controlling means 40 (described later), and the number of nonreflective sections 50*a* of the detected identification mark 50 is counted in the controlling means 40 in order to determine whether the cassette that is detected is one of the image-formation ribbon cassettes 27 or the light-shielding ribbon cassette 29 and to determine, if the cassette is an image-formation ribbon cassette 27, the type of image-formation ink ribbon 37 (or the color of the ink) which is accommodated in the identified image-formation ribbon cassette 27. With the identification mark 50 of the corresponding ink ribbon 27 or 29 to be used being detected by the optical sensor 39, the carriage 26 can stop. With the carriage 26 being stopped, the identified image-formation ribbon cassette 27 or the light-shielding ribbon cassette 29 disposed on its corresponding cassette holder at the canopy 41 is automatically transferred onto the top carriage 26*b*.

As shown in FIG. 9 a sheet insertion opening 51 for advancing the print medium 2 (see FIGS. 1 to 3) formed of, at least, a transparent material is formed behind the platen 23. A transportation roller 52 for transporting the print medium 2 at a predetermined speed is formed in a portion of the sheet-insertion opening 51.

Instead of the print medium 2, the print medium 2A shown in FIGS. 5 and 6, or the print medium 2B shown in FIGS. 7 and 8 may also be used.

As shown in FIG. 12, a reference position marker 53 which indicates a reference position in order to detect a reference position of the transportation roller 52 when a printing operation is executed is provided on the transportation roller 52 so as to be integrally rotatable therewith. The reference position marker 53 is, for example, a reflective seal or a reflective plate, and is disposed away from the path in which the print medium 2 runs. The reference position marker 53 is detected every time the transportation roller 52 rotates once by a detecting means 54, such as an optical sensor, disposed away from the print-medium 2 running path situated near the transportation roller 52. The detecting means 54 is electrically connected to the controlling means 40 (described later) used to control the operation of each part of the thermal transfer printer 21. A detection signal from the reference position marker 53 is such as to be sent to the controlling means 40. The detecting means 54 may be a contact-type detecting means.

Returning to FIG. 9, a press-contact roller 55 which press-contacts the transportation roller 52 is rotatably disposed below the transportation roller 52. A roller drive gear 56 coaxially mounted to the transportation roller 52 is disposed at the left side (in FIG. 9) of the printer frame 22 so as to project therefrom. A motor gear 59 mounted to an output shaft 58a (see FIG. 12) of a drive motor 58 which is a stepping motor is connected to the roller drive gear 56 through transmission gears 57 and 57. By rotationally driving the transportation roller 52 through the motor gear 59, the transmission gears 57 and the roller drive gear 56 in that order as a result of driving the drive motor 58, the print medium 2 inserted between the transportation roller 52 and the press-contact roller 55 from the sheet insertion opening 51 is sandwiched and transported. As shown in FIG. 12, the drive motor 58 is electrically connected to the controlling means 40, and is rotationally driven based on a control command sent out from the controlling means 40. In the embodiment, the rotational position of the transportation roller 52 is computed from the number of steps of the drive motor 58 which is driven, and, based on the computed value, the number of steps of the drive motor 58 which is driven is controlled, making it possible to provide a structure which can allow transporation by an accurate amount.

A transportation means 60 for transporting the print medium 2 used in the embodiment comprises the press-contact roller 55, the roller drive gear 56, the transmission gears 57, and the motor gear 59.

A transportation guide (not shown) for controlling the transportation location and posture of the print medium 2 is disposed at the printer frame 22 so as to face the path in which the print medium 2 is transported.

As shown in FIG. 13, the controlling means 40 which controls the operation of each part comprises, at least, an I/O interface 65 used for electrically connecting the controlling means 40 to each part of the thermal transfer printer 21, a CPU 66, and a memory 67 which is, for example, ROM or RAM with a proper capacity.

To the I/O interface 65 are electrically connected at least, for example, the thermal head 32, the optical sensor 39, the detecting means 54, the drive motor 58, a power switch (not shown), various operation switches disposed on an operation panel, and an indicator means.

The memory 67 incorporates at least a printing operation controlling section 69. A controlling program is stored in the printing operation controlling section 69. In this program, at least when a printing operation is executed, any one of the image-formation ink ribbons 37 is selected, and, based on print information, the heating elements of the thermal head 32 are selectively driven. This causes the image-formation ink of the selected image-formation ink ribbon 37 to be thermally transferred within the image-formation area 5 of the print medium 2, whereby an ink image 3 which is a mirror image is printed. Thereafter, the light-shielding ribbon 45 is selected, and the heating elements of the thermal head 32 are driven, causing the light-shielding layer ink to be thermally transferred to at least the front surface of the image 3. This causes at least the front surface of the print medium 2 where the image 3 is formed to be covered with the light-shielding layer ink, whereby a light-shielding layer printing operation is carried out.

More specifically, in the controlling program stored in the printing operation controlling section 69 used in the embodiment, at least when a printing operation is executed, any one of the image-formation ribbon cassettes 27 which accommodate the corresponding image-formation ink ribbons 37 is selected for automatically replacing any cassette on the carriage 26, and is placed on the carriage 26. Based on the print information, the heating elements of the thermal head 32 are selectively driven. This causes the image-formation ink of the selected image-formation ink ribbon 37 to be thermally transferred within the image-formation area 5 of the print medium 2. Thereafter, the light-shielding ribbon cassette 29 which accommodates the light-shielding layer ink ribbon 45 is selected for automatically replacing the cassettes 27 on the carriage 26. By driving the heating elements of the thermal head 32 carried by the carriage 26, the light-shielding layer ink is thermally transferred to at least the front surface of the image 3 in order to cover at least the front surface of the print medium 2 where the image 3 is formed with the light-shielding layer ink.

Predetermined print data input from, for example, a host computer or an image reader, or by a suitable input device (not shown) such as a keyboard is stored in the memory 67. When the image 3 is to be printed, the heating elements of the thermal head 32 are, based on the print data, selectively driven and are caused to generate heat. In forming the full color image 3 with ink, the print data is stored as three separate pieces of print data according to at least the three colors Y, M, and C used for printing. When the image 3 is printed, the pieces of print data provided in correspondence with the three colors, Y, M, and C of the image-formation ink ribbons 37 used for printing can be output to the thermal head 32. The pieces of print data provided according to the colors used to form the image 3 are output to the thermal head 32 after row-direction addresses are reversed in a horizontal direction. Thus, the image 3 which is a mirror image can be easily obtained.

Programs are stored in the memory 67 used in the embodiment. They include a program executed to control a movement of the thermal head 32 towards and away from the platen 23 during printing; a program executed to determine or detect, based on an output signal generated from the optical sensor 39 as a result of the movement of the carriage 26, the presence or absence of any one of the image-formation ribbon cassettes 27 and the type of image-formation ink ribbon 37 accommodated in the detected image-formation ribbon cassette 27, the presence or absence of the light-shielding ribbon cassette 29, the distance of movement of the carriage 26 from a home position, whether or not the canopy 41 is in an open or a closed state, the distance between adjacent ribbon cassettes 27 and ribbon cassette 29, etc.; a program executed to automatically replace the image-formation ribbon cassettes 27 and the light-shielding ribbon cassette 29 in the order set by the program; and a program executed to detect any abnormality in the transportation of the print medium 2. In addition, the memory 67 also stores various pieces of data required for printing.

There may be used a structure in which the image reader is mounted in the thermal transfer printer 21 itself.

In the thermal transfer printer 21, the memory 67 may store a controlling program executed to perform an ordinary printing operation carried out to form a full-color image on the surface of a print medium, such as an ordinary sheet, similar to a conventional print medium. In this case, a structure which incorporates, for example, an operation changeover switch (not shown) for switching printing operations may be used.

A description of the operation of the thermal transfer printer of the embodiment having the above-described structure and the printing method of the present invention will be given.

In the printing operation performed on the above-described print medium 2 to obtain the printed material 1 by the thermal transfer printer 21 of the embodiment, the controlling program stored in the printing operation controlling section 69 of the controlling section 40 is used to select any one of the image-formation ribbon cassettes 27 accommodating the corresponding image-formation ink ribbons 37 for automatically replacing any cassette on the carriage 26 in order to place the selected image-formation ribbon cassette 27 onto the carriage 26. Based on the print information, the heating elements of the thermal head 32 are selectively driven in order to thermally transfer the ink of the selected ink ribbon 37 within the image-formation area 5 of the print medium 2 which is used, whereby the desired image 3 which is a mirror image formed with ink is printed. After the printing of the image 3, the light-shielding ribbon cassette 29 accommodating the light-shielding layer ink ribbon 45 is selected for automatically replacing the cassette 27 on the carriage 26, and placed on the carriage 26. By driving the heating elements of the thermal head 32, the light-shielding layer ink is thermally transferred onto at least the surface of the image 3 in order to cover at least the surface of the print medium 2 where the image 3 is formed with the light-shielding layer ink, whereby light-shielding printing is carried out.

More specifically, the printing operation on the print medium 2 is carried out by forming the desired image 3 which is a mirror image formed with ink within the image-formation area 5 of the print medium 2 used. In forming the desired image 3, the image-formation ribbon cassette 27 which accommodates the ink ribbon 37 coated with color ink required for a first printing operation, such as the yellow image-formation ribbon cassette 27 which accommodates the yellow image-formation ink ribbon 37, is selected, and placed on the carriage 26. The transportation roller 52 is used to forwardly transport the print medium 2 to the start of the page. Then, with the thermal head 32 in a head-down state, the yellow image-formation ink ribbon 37 and the print medium 2 are sandwiched between the platen 23 and thermal head 32 in order to reciprocate the thermal head 32 along with the carriage 26 along the platen 23. In addition, while the yellow image-formation ink ribbon 37 is taken up, the heating elements of the thermal head 32 are, based on the print data, selectively energized and are caused to generate heat in order to repeatedly thermally transfer portions of the yellow image-formation ink of the yellow image-formation ink ribbon 37 onto the print medium 2 so that each line is subjected to printing, whereby printing within the image-formation area 5 is executed with the yellow image-formation ink.

Thereafter, the yellow image-formation ribbon cassette 27 is replaced with the image-formation cassette 27 which accommodates the image-formation ink ribbon 37 with color ink used for the next printing, such as the magenta image-formation ribbon cassette 27 which accommodates the magenta image-formation ink ribbon 37 coated with magenta image-formation ink. In addition, the transportation roller 52 is used to reversely transport, that is, backfeed, the print medium 2 to the start of the page. As in the printing using yellow image-formation ink, the magenta image-formation ink ribbon 37 coated with magenta image-formation ink is used to execute printing within the image-formation area 5 of the print medium 2 with magenta image-formation ink.

Thereafter, the magenta image-formation ribbon cassette 27 is replaced with the image-formation ribbon cassette 27 which accommodates the image-formation ink ribbon 37 coated with color ink required for the next printing, such as the cyan image-formation ribbon cassette 27 which accommodates the cyan image-formation ink ribbon 37 coated with cyan image-formation ink. In addition, the print medium 2 is again reversely transported to the start of the page. As in the printing using the yellow image-formation ink, the cyan image-formation ink ribbon 37 coated with cyan image-formation ink is used to perform printing within the image-formation area 5 of the print medium 2 using the cyan image-formation ink, whereby the full-color image 3 which is a mirror image formed with ink by placing upon each other the three types of image-formation ink of three colors, the Y ink, the M ink, and the C ink is formed on the front surface within the image-formation area 5 of the print medium 2.

The print data for each color used to form the image 3 is output to the thermal head 32 after line-direction addresses are reversed in a horizontal direction, so that the image 3 which is a mirror image formed with ink can be easily obtained.

Thereafter, when the printing of the image 3 which is a mirror image formed within the image-formation area 5 of the print medium 2 is completed, the light-shielding ribbon cassette 29 which accommodates the light-shielding layer ink ribbon 45 is selected and placed on the carriage 26. The transportation roller 52 is used to reversely transport the print medium 2 to the start of the page. Then, with the thermal head 32 in a head-down state, the light-shielding layer ink ribbon 45 and the print medium 2 are sandwiched between the platen 23 and the thermal head 32 in order to reciprocate the thermal head 32 along with the carriage 26 along the platen 23. In addition, while the light-shielding ribbon 45 is taken up, the heating elements of the thermal head 32 are energized and are caused to produce heat in order to repeatedly thermally transfer the light-shielding layer ink onto at least the front surface of the image 3 so that, in the embodiment, each line within at least the image-formation area 5 is subjected to printing, whereby printing within the image-formation area 5 with the light-shielding layer ink which is metallic ink is carried out. Thus, it is easy to cover the front surface of the image 3 with the light-shielding layer 4 formed with light-shielding layer ink.

The head-up and head-down operations of the thermal head 32 during printing, the transportation and reverse transportation of the print medium 2, the replacement of the image-formation ribbon cassettes 27 and the light-shielding ribbon cassette 29, and other such operations are the same as those performed by a conventional thermal transfer printer which incorporates a plurality of ribbon cassettes. Therefore, these operations will not be described in detail.

The thermal transfer printer 21 of the embodiment can be used to easily perform a printing method in which, after printing the image 3 which is a mirror image within the image-formation area 5 of the surface of the print medium 2 which is a transparent member, the light-shielding layer ink is thermally transferred onto at least the surface of the image 3 so as to cover it, whereby the light-shielding printing is achieved. As a result, it is possible to form the image 3 which is a mirror image formed using image-formation ink within the image-formation area 5 of the surface of the print medium 2 which is a transparent member in order to cover at least the surface of the image 3 by the light-shielding layer 4 formed with light-shielding layer ink, whereby the printed matter 1 is obtained. In addition, the image 3 which is a mirror image formed on the front surface of the print medium 2 which is a transparent member of the printed matter 1 can be viewed as a normal image without its left and right sides being reversed when viewed through the print medium 2 from the back side thereof. In addition, the light-shielding layer 4 is highly capable of shielding the image 3 formed on the front surface of the print medium 2. Therefore, it is possible to make it easier to view the image 3 through the print medium 2 which is a transparent member from the back side thereof.

Consequently, it is easy to obtain the printed matter 1 whose image 3 surface has uniform gloss, and whose image 3 has enhanced appearance, is of high quality, does not have its left and right sides reversed, and is easy to see when viewed through the print medium 2 from the back side thereof.

In addition, when thermal printing is carried out using the thermal transfer printer 21 of the embodiment, the image 3 which is a mirror image, and the light-shielding layer 4 can be easily formed on the print medium 2.

Further, according to the thermal transfer printer 21 of the embodiment, the image 3 and the light-shielding layer 4 can be easily formed using as a transparent film or a transparent sheet for the print medium 2.

Still further, according to the thermal printer 21 of the embodiment, the light-shielding layer 4 formed with metallic ink can be easily formed on the surface of the image 3, and the image 3 can be more properly shielded thereby. Therefore, the image 3 when viewed through the print medium 2 from the back side thereof can be more easily seen.

Still further, according to the thermal transfer printer 21 of the embodiment, even in the cases where the above-described print media 2A and 2B are used, the image 3 and the light-shielding layer 4 can be easily formed within the image-formation areas 5A and 5B of the corresponding print media 2A and 2B. Therefore, printed matter 1A*a* and 1B*a* smaller than the print media 2A and 2B themselves can be easily obtained without carrying out a post-processing operation.

Figure 14:
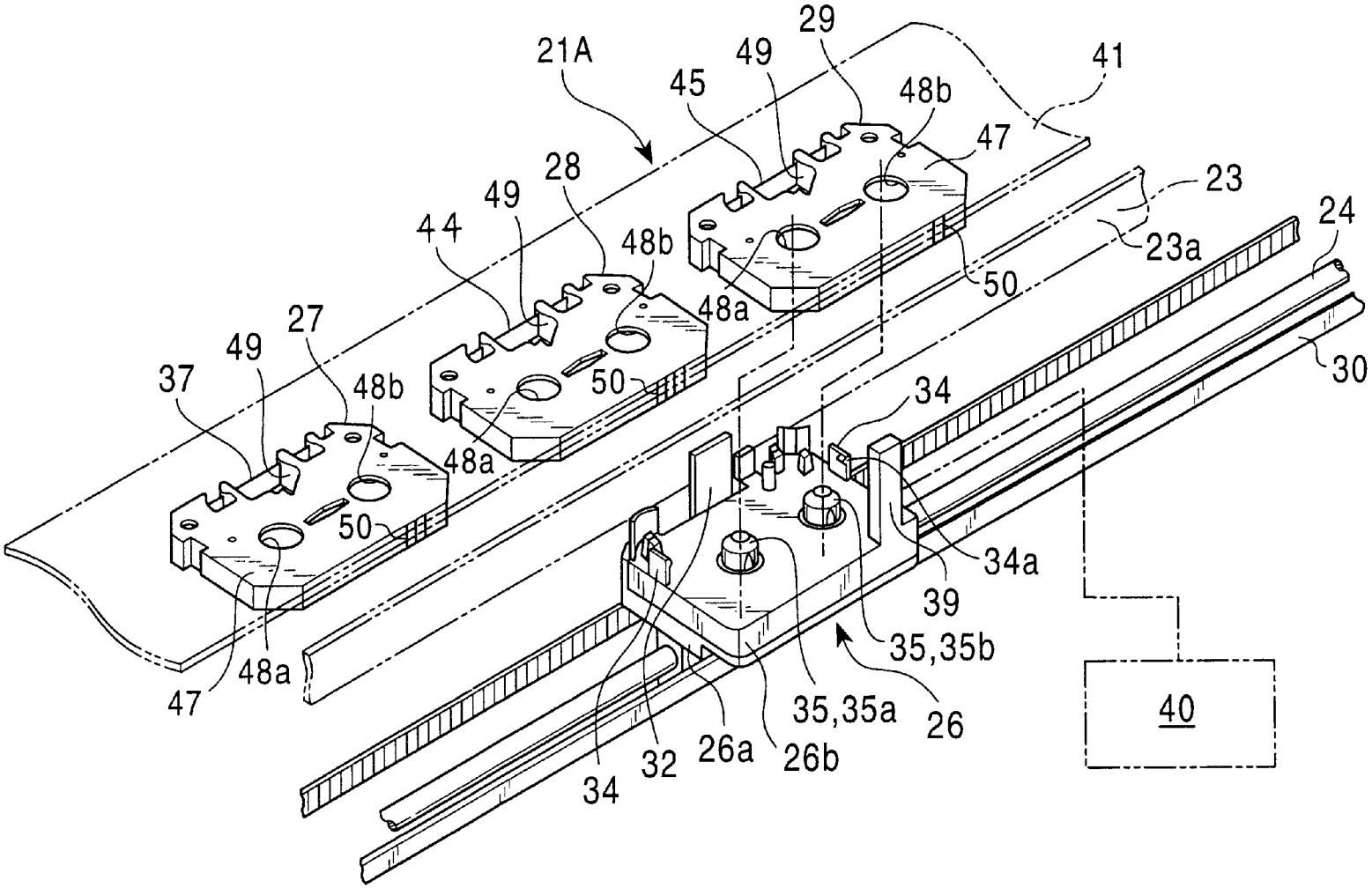
FIG. 14 is an enlarged perspective view of a carriage and component parts around the carriage used in a second embodiment of the printer of the present invention used in a printing method of the present invention.
Figure 15:
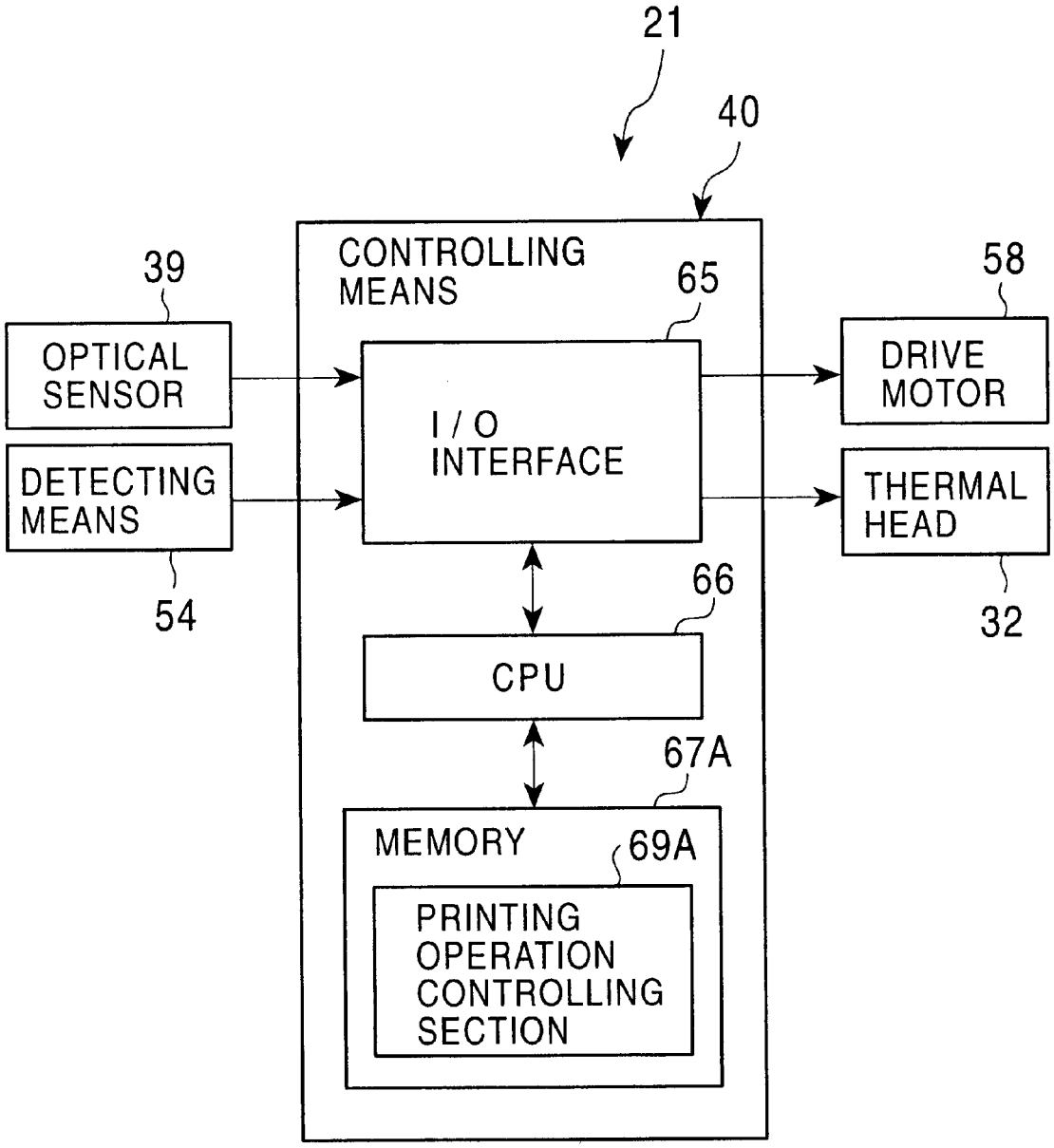
FIG. 15 is a block diagram schematically showing a means for controlling the printer of FIG. 14.

FIGS. 14 and 15 illustrate a second embodiment of the printer in accordance with the present invention which can be used to carry out the printing method of the present invention.

The printer of the second embodiment is used to perform a thermal transfer operation to form a full-color image as an image 3 which is a mirror image onto a print medium 2 which is a transparent member using a total of three image-formation ribbon cassettes used in printing the full-color image. The first type of image-formation ribbon cassette accommodates an image-formation ink ribbon coated with Y (that is, yellow) image-formation ink. The second type of image-formation cassette accommodates an image-formation ink ribbon coated with M (that is, magenta or purplish red) image-formation ink. The third type of image-formation cassette accommodates an image-formation ink ribbon coated with C (that is, cyan or greenish blue) image-formation ink. After the formation of the full-color image, an underlying layer ribbon cassette which accommodates an underlying layer ink ribbon coated with underlying layer ink is used to thermally transfer the underlying layer ink onto the front surface of the image 3 and at least a blank space section 6 within an image-formation area 5 of the print medium 2 in order to form an underlying layer 8. Then, a light-shielding ribbon cassette which accommodates a light-shielding layer ink ribbon coated with light-shielding layer ink is used to thermally transfer the light-shielding layer ink onto the surface of the underlying layer 8 in order to form a light-shielding layer, whereby the printed matter 1A is obtained.

As shown in FIG. 14, in the thermal transfer printer 21A of the embodiment, three image-formation ribbon cassettes 27 (only one of them is shown in FIG. 14) used to print the full-color image 3 which is a mirror image, an underlying layer ribbon cassette 28 which accommodates an underlying layer ink ribbon 44, and a light-shielding ribbon cassette 29 which accommodates a light-shielding layer ink ribbon 45 are arranged in a row along a direction of movement of a carriage 26 using a plurality of cassette holders (not shown) provided at predetermined locations of the bottom surface of a canopy 41 opposing the carriage 26. The three image-formation ribbon cassettes 27 separately accommodate corresponding image-formation ink ribbons 37 coated with corresponding types of image-formation ink of three colors, Y ink, M ink, and C ink, which are at least necessary to form the image 3.

In the embodiment, the underlying layer ink ribbon 44 carries underlying layer ink. It comprises a layer including heat-sensitive (a heat-fusible or a heat-hardening) underlying layer ink coated on one surface of a support member, with the other surface of the support member being subjected to heat resistance processing using silicone-mixed resin. The layer coated with underlying layer ink is a layered structure formed by placing a release layer and an underlying ink layer upon each other in that order from the supporting member side.

The supporting member and the release layer are similar to those used in the above-described image-formation ink ribbons 37.

For the underlying layer ink, it is preferable to use, in addition to those used in the above-described image-formation ink ribbons 37, a white material, such as titanium oxide, as a coloring agent. It is preferable that the melt viscosity of the release layer and the underlying ink layer where the underlying layer ink is used at 160° C. be less than the melt viscosity of the three types of image-formation ink used to form the image at 160° C. It is most preferable that the melt viscosity of the separation-type layer where the underlying layer ink is used at 160° C. be less than the melt viscosity of the release layers where the three types of image-formation ink for forming the image at 160° C.

In other words, it is important that the melt viscosity of the underlying layer ink resulting from the temperature produced when the underlying layer ink is being thermally transferred by the thermal head 32 be lower than the melt viscosity of the image-formation ink resulting from the temperature produced when the image-formation ink is being thermally transferred by the thermal head 32. This means that it is important that the underlying layer ink has greater fluidity than the image-formation ink.

Although, it is most preferable to use white in order to make the image 3 stand out when viewed through the print medium 2 which is a transparent member from the back side thereof, light yellow or light pink may also be used, in addition to white, in order to make the image 3 stand out and make it pleasing to look at.

As shown in FIG. 15, a memory 67A of a controlling means 40 of the thermal transfer printer 21A of the embodiment includes at least a printing operation controlling section 69A. A controlling program is stored in the printing operation controlling section 69A. In this program, at least when a printing operation is executed, any one of the image-formation ink ribbons 37 is selected, and, based on print information, the heating elements of the thermal head 32 are selectively driven. This causes the image-formation ink of the selected image-formation ink ribbon 37 to be thermally transferred within the image-formation area 5 of the print medium 2, whereby the image 3 which is a mirror image formed with ink is printed. Thereafter, the underlying layer ink ribbon 44 is selected, and the heating elements of the thermal head 32 are driven, causing the underlying layer ink to be thermally transferred onto the surface of the image 3 of the print medium 2 and at least the blank space section 6 within the image-formation area 5 of the print medium 2, whereby the surface within the image-formation area 5 of the print medium 2 is covered with the underlying layer ink and thus is subjected to underlying layer printing. After the underlying layer printing operation, the light-shielding layer ink ribbon 45 is selected and the heating elements of the thermal head 32 are driven, causing the light-shielding layer ink to be thermally transferred onto the surface of the print medium 2 which has been subjected to the underlying layer printing, whereby the surface of the print medium 2 subjected to the underlying layer printing is covered with the light-shielding layer ink, and thus is subjected to light-shielding layer printing.

More specifically, in the controlling program stored in the printing operation controlling section 69A of the embodiment, at least when the printing operation is executed, any one of the image-formation ribbon cassettes 27 which accommodates the corresponding image-formation ink ribbon 37 is selected for automatically replacing any cassette on the carriage 26, and is placed on the carriage 26. Based on the print information, the heating elements of the thermal head 32 are selectively driven. This causes the image-formation ink of the selected image-formation ink ribbon 37 to be thermally transferred within the image-formation area 5 of the print medium 2, whereby the image 3 which is a mirror image is printed. Thereafter, the underlying layer ribbon cassette 28 which accommodates the underlying layer ink ribbon 44 is selected for automatically replacing the cassette on the carriage 26. By driving the heating elements of the thermal head 32, the underlying layer ink is thermally transferred onto the surface of the image 3 on the print medium 2 and at least the surface of the blank space section 6 within the image-formation area 5 of the print medium 2 in order to cover the surface of the image-formation area of the print medium 2 with the underlying layer ink and thus to subject it to the underlying layer printing. Thereafter, the light-shielding ribbon cassette 29 which accommodates the light-shielding layer ink ribbon 45 is selected for automatically replacing the cassette on the carriage 26, and is placed on the carriage 26. By driving the heating elements of the thermal head 32, the light-shielding layer ink is thermally transferred onto the surface of the print medium 2 that has been subjected to the underlying layer printing, whereby it is covered with the light-shielding layer ink, and thus is subjected to the light-shielding layer printing.

The memory 67A used in the embodiment also stores a program used to detect the absence or presence of the underlying layer ribbon cassette 28 and to make determinations.

The other structural features are the same as those of the thermal transfer printer 21 of the above-described first embodiment.

In the printing operation performed on the print medium 2 carried out to obtain the printed matter 1 by the thermal transfer printer 21 of the embodiment having the above-described structure, when the controlling program stored in the printing operation controlling section 69A of the controlling means 40 is executed, the printing of the image 3 which is a mirror image within the image-formation area 5 of the surface of the print medium 2 is followed by the thermal transfer of the underlying layer ink onto the surface of the image 3 and at least the blank space section 6 within the image-formation area 5 of the print medium 2. After the thermal transfer of the underlying layer ink, the light-shielding layer ink is thermally transferred so as to cover the surface of the print medium 2 that has been subjected to the underlying layer printing, whereby the light-shielding printing is executed.

More specifically, the printing operation on the print medium 2 is started by forming the desired image 3 which is a mirror image formed with ink within the image-formation area 5 of the print medium 2 used. As when the thermal transfer printer 21 of the first embodiment is used, in forming the desired image 3, the image-formation ribbon cassette 27 which accommodates the ink ribbon 37 coated with color ink required for a first printing operation, such as the yellow image-formation ribbon cassette 27 which accommodates the yellow image-formation ink ribbon 37, is selected, and placed on the carriage 26. The transportation roller 52 is used to forwardly transport the print medium 2 to the start of the page. Then, with the thermal head 32 in a head-down state, the yellow image-formation ink ribbon 37 and the print medium 2 are sandwiched between the platen 23 and thermal head 32 in order to reciprocate the thermal head 32 along with the carriage 26 along the platen 23. In addition, while the yellow image-formation ink ribbon 37 is taken up, the heating elements of the thermal head 32 are, based on the print data, selectively energized and are caused to generate heat in order to repeatedly thermally transfer portions of the yellow image-formation ink of the yellow image-formation ink ribbon 37 onto the print medium 2 so that each line is subjected to printing, whereby printing within the image-formation area 5 is executed with the yellow image-formation ink.

Thereafter, the yellow image-formation ribbon cassette 27 is replaced with the image-formation cassette 27 which accommodates the image-formation ink ribbon 37 with color ink used for the next printing, such as the magenta image-formation ribbon cassette 27 which accommodates the magenta image-formation ink ribbon 37 coated with magenta image-formation ink. In addition, the transportation roller 52 is used to reversely transport, that is, backfeed, the print medium 2 to the start of the page. As in the printing using yellow image-formation ink, the magenta image-formation ink ribbon 37 coated with magenta image-formation ink is used to execute printing within the image-formation area 5 of the print medium 2 with magenta image-formation ink.

Thereafter, the magenta image-formation ribbon cassette 27 is replaced with the image-formation ribbon cassette 27 which accommodates the image-formation ink ribbon 37 coated with color ink required for the next printing, such as the cyan image-formation ribbon cassette 27 which accommodates the cyan image-formation ink ribbon 37 coated with cyan image-formation ink. In addition, the print medium 2 is again reversely transported to the start of the page. As in the printing using the yellow image-formation ink, the cyan image-formation ink ribbon 37 coated with cyan image-formation ink is used to perform printing within the image-formation area 5 of the print medium 2 using the cyan image-formation ink, whereby the full-color image 3 which is a mirror image formed with ink by placing upon each other the three types of image-formation ink of three colors, the Y ink, the M ink, and the C ink is formed on the front surface within the image-formation area 5 of the print medium 2.

The print data for each color used to form the image 3 is output to the thermal head 32 after line-direction addresses are reversed in a horizontal direction, so that the image 3 which is a mirror image formed with ink can be easily obtained.

Thereafter, when the printing of the image 3 which is a mirror image formed within the image-formation area 5 of the print medium 2 is completed, the underlying layer ribbon cassette 28 which accommodates the-underlying layer ink ribbon 44 is selected and placed on the carriage 26. The transportation roller 52 is used to reversely transport the print medium 2 to the start of the page. Then, with the thermal head 32 in a head-down state, the underlying layer ink ribbon 44 and the print medium 2 are sandwiched between the platen 23 and the thermal head 32 in order to reciprocate the thermal head 32 along with the carriage 26 along the platen 23. In addition, while the underlying layer ink ribbon 44 is taken up, the heating elements of the thermal head 32 are energized and are caused to produce heat in order to repeatedly thermally transfer the underlying layer ink at least within the image-formation area 5 of the print medium 2 so that, in the embodiment, each line within at least the image-formation area 5 is subjected to printing, whereby printing within the image-formation area 5 with white underlying layer ink is performed. This allows the front surface of the image 3 and at least the surface of the blank space section 6 within the image-formation area 5 of the print medium 2 to be easily covered with the underlying layer 8 formed with underlying layer ink.

When the printing operation within at least the image-formation area 5 of the print medium 2 with the underlying layer ink is completed, the light-shielding ribbon cassette 29 which accommodates the light-shielding layer ink ribbon 45 is selected and placed on the carriage 26. Then, the print medium 2 is reversely transported to the start of the page by the transportation roller 52, after which, while the thermal head 32 is in a head-down state, the light-shielding layer ink ribbon 44 and the print medium 2 are sandwiched between the platen 23 and the thermal head 32 in order to reciprocate the thermal head 32 along with the carriage 26 along the platen 23. In addition, while taking up the light-shielding layer ink ribbon 45, the heating elements of the thermal head 32 are energized and are caused to generate heat in order to repeatedly thermally transfer the light-shielding layer ink of the light-shielding layer ink ribbon 44 within at least the image-formation area 5 of the print medium 2 so that each line is subjected to printing, whereby the printing within the image-formation area 5 using the light-shielding layer ink which is metallic ink is executed. Thus, the surface of the underlying layer 8 can be easily covered with the light-shielding layer 4.

Head-down and head-up operations of the thermal head 32 when printing is executed, transportation and reverse transportation of the print medium 2, replacement of the ribbon cassettes 27, the underlying layer ribbon cassette 28, and the light-shielding ribbon cassette 29, and other such operations are the same as those performed by a conventional thermal transfer printer incorporating a plurality of ribbon cassettes. Therefore, they will not be described in detail.

The thermal transfer printer 21A of the embodiment can be used to easily perform the printing method in which, after printing the image 3 which is a mirror image within the image-formation area 5 of the front surface of the print medium 2 which is a transparent member, the underlying layer ink is thermally transferred onto the surface of the image 3 and at least the surface of the blank space section 6 within the image-formation area 5 of the print medium 2 in order to achieve the underlying layer printing. Thereafter, the light-shielding layer ink is thermally transferred onto the surface of the print medium 2 that has been subjected to the underlying layer printing so as to cover it. As a result, it is possible to form the image 3 within the image-formation area 5 of the front surface of the print medium 2 which is a transparent member, to cover the surface of the image 3 and at least the surface of the blank space section 6 within the image-formation area 5 of the print medium 2 with the underlying layer 8 formed with underlying layer ink, and to cover the surface of the underlying layer 8 with the light-shielding layer 4 formed with light-shielding layer ink, whereby the printed matter 1 can be easily obtained. The image 3 formed on the front surface of the print medium 2 which is a transparent member of the printed matter 1 can be viewed as a normal image whose left and right sides are not reversed when it is viewed through the print medium 2 from the back side thereof. In addition, the underlying layer 8 and the light-shielding layer 4 are highly capable of shielding the image 3 formed on the front surface of the print medium 2. Therefore, it is possible to make it easier to see the image 3 when it is viewed through the print medium 2 which is a transparent member from the back side thereof.

Consequently, it is possible to easily obtain the printed matter 1 whose image 3 surface has uniform gloss, and whose image 3 has enhanced appearance, is of high quality, does not have its left and right sides reversed, and is easy to see.

By performing thermal transfer printing using the thermal transfer printer 21A of the embodiment, the image 3 and the light-shielding layer 4 can be easily formed on the print medium 2.

According to the thermal transfer printer 21A of the embodiment, the melt viscosity of the underlying layer ink at 160° C. used to form the underlying layer 8 is less than the melt viscosity of the three types of image-formation ink at 160° C. used to form the image 3. Therefore, at approximately 160° C. during thermal transfer of the underlying layer ink, the underlying layer ink has high fluidity, whereas, at 160° C., the three types of image-formation ink that have already been thermally transferred onto the print medium 2 has low fluidity. Consequently, the underlying layer 8 can be easily formed without affecting the image 3.

In addition, according to the thermal transfer printer 21A of the embodiment, the white underlying layer 8 formed with white underlying layer ink causes the image 3 when viewed through the print medium 2 from the back side thereof to stand out. Therefore, it is possible to make it easier to see the image 3.

Further, according to the thermal transfer printer 21A of the embodiment, the image 3, the underlying layer 8, and the light-shielding layer 4 can be easily thermally transferred by using a transparent film or a transparent sheet for the print medium 2.

Still further, according to the thermal transfer printer 21A of the embodiment, the light-shielding layer 4 formed with metallic ink can be easily formed on the surface of the underlying layer 8, and the shielding the image 3 can be more properly shielded. Therefore, it is possible to make it easier to see the image 3 when it is viewed through the print medium 2 from the back side thereof.

Still further, according to the thermal transfer printer 21A, even in the cases where the above-described print media 2A and 2B are used, the images 3 and the light-shielding layers 4 can be easily formed within the image-formation areas 5A and 5B of the print media 2A and 2B, respectively. Therefore, printed matter 1A*a* and 1B*a* smaller than the print media 2A and 2B themselves can be easily obtained without a post-processing operation.

The present invention is not limited to the above-described embodiments so that various modifications may be made when required. For example, one or more line thermal heads which can be used to print a maximum length of an image in a line direction, or a thermal transfer line printer which uses wide sheet-shaped image-formation ink ribbons, a wide sheet-shaped underlying layer ink ribbon, and a wide sheet-shaped light-shielding layer ink ribbon may also be used as the thermal head.

According to each piece of printed matter of the present invention, each image which is a mirror image formed with ink on the front surface of each print medium which is a transparent member can be viewed as a normal image without its left and right sides reversed when it is viewed through its corresponding print medium from the back side thereof, and each underlying layer and each light-shielding layer are highly capable of shielding its corresponding image formed on the front surface of each print medium, so that it becomes easier to see each image when it is viewed through its corresponding print medium which is a transparent member from the back side thereof. Consequently, a tremendous advantage of the present invention is that each piece of printed matter has an image surface having uniform gloss, and has formed thereon an image which has enhanced appearance, is of high quality, does not have its left and right sides reversed, and is easy to see when viewed through its corresponding print medium from the back side thereof.

According to each piece of printed matter of the present invention, a tremendous advantage of the present invention in that each image, each underlying layer, and each light-shielding layer can be easily formed on its corresponding print medium by thermal transfer printing.

According to each piece of printed matter of the present invention, the fluidity of underlying layer ink at 160° C. is high, whereas the fluidity of image-formation ink is low. Therefore, a tremendous advantage of the present invention is that each underlying layer can be easily formed on its corresponding image without affecting it.

According to each piece of printed matter of the present invention, each white underlying layer causes its corresponding image to stand out when it is viewed through its corresponding print medium which is a transparent member from the back side thereof. Therefore, a tremendous advantage of the present invention is that each image can be more easily seen.

According to each piece of printed matter of the present invention, a tremendous advantage of the present invention is that, by the use of a transparent film or a transparent sheet, each image and each light-shielding layer, or each image, each underlying layer, and each light-shielding layer can be easily formed.

According to each piece of printed matter of the present invention, metallic ink is highly capable of shielding its corresponding image. Therefore, a tremendous advantage of the present invention is that each image can be more easily seen when viewed through its corresponding print medium from the back side thereof.

According to each piece of printed matter, a tremendous advantage is provided in that a piece of printed matter smaller than the corresponding printed matter itself can be easily obtained without a post-processing operation.

According to each printing method of the present invention, a tremendous advantage is provided in that each piece of printed matter can be easily obtained.

According to each printer of the present invention, a tremendous advantage is provided in that each printing method can be easily carried out using a simple structure, so that each piece of printed matter can be easily obtained.

Therefore, the present invention is highly effective in making it easy to provide, by moving any one of the printers of the present invention in accordance with any one of the printing methods, any one of the pieces of printed matter of the present invention whose image surface has uniform gloss, and whose image has enhanced appearance, is of high quality, does not have its left and right sides reversed, and is easy to see.

What is claimed is:

1. A printer comprising:

a thermal head including an image-formation ink ribbon, an underlying layer ink ribbon, a light-shielding layer ink ribbon, and a plurality of heating elements disposed in a row; and controlling means for controlling an operation of each of the image-formation ink ribbon, the underlying layer ink ribbon, the light-shielding layer ink ribbon, and the heating elements;

wherein the melt viscosity at 160° C. of the underlying layer ink of the underlying layer ink ribbon is lower than the melt viscosity at 160° C. of the image-formation ink of the image-formation ink ribbon used to form an image with ink; and wherein the controlling means is constructed so that, at least during printing, first, the image-formation ink ribbon is selected, and, based on print information, the heating elements of the thermal head are selectively driven in order to thermally transfer image-formation ink of the image-formation ink ribbon within an image-formation area of a print medium, causing an image which is a mirror image formed with ink to be printed, after which, by selecting the underlying layer ink ribbon and driving the heating elements of the thermal head, underlying layer ink is thermally transferred onto a surface of the image on the print medium and at least a surface of a blank space section within the image-formation area of the print medium, causing the surface within the image-formation area of the print medium to be subjected to underlying layer printing in order to cover the surface within the image-formation area of the print medium with the underlying layer ink, after which, by selecting the light-shielding layer ink ribbon and driving the heating elements of the thermal head, light-shielding layer ink is thermally transferred onto the surface of the print medium that has been subjected to the underlying layer printing, causing the surface of the print medium that has been subjected to the underlying layer printing to be subjected to light-shielding layer printing in order to cover the surface of the print medium that has been subjected to the underlying layer printing with the light-shielding layer ink.

2. A printer according to claim 1, wherein the underlying layer ink of the underlying layer ink ribbon is white.

3. A printer comprising:

a thermal head including an image-formation ink ribbon, an underlying layer ink ribbon, a light-shielding layer ink ribbon, and a plurality of heating elements disposed in a row; and controlling means for controlling an operation of each of the image-formation ink ribbon, the underlying layer ink ribbon, the light-shielding layer ink ribbon, and the heating elements;

wherein the controlling means is constructed so that, at least during printing, first, the image-formation ink ribbon is selected, and, based on print information, the heating elements of the thermal head are selectively driven in order to thermally transfer image-formation ink of the image-formation ink ribbon within an image-formation area of a print medium, causing an image which is a mirror image formed with ink to be printed, after which, by selecting the underlying layer ink ribbon and driving the heating elements of the thermal head, underlying layer ink is thermally transferred onto a surface of the image on the print medium and at least a surface of a blank space section within the image-formation area of the print medium which is a transparent film or a transparent sheet, causing the surface within the image-formation area of the print medium to be subjected to underlying layer printing in order to cover the surface within the image-formation area of the print medium with the underlying layer ink, after which, by selecting the light-shielding layer ink ribbon and driving the heating elements of the thermal head, light-shielding layer ink is thermally transferred onto the surface of the print medium that has been subjected to the underlying layer printing, causing the surface of the print medium that has been subjected to the underlying layer printing to be subjected to light-shielding layer printing in order to cover the surface of the print medium that has been subjected to the underlying layer printing with the light-shielding layer ink.

4. A printer comprising:

a thermal head including an image-formation ink ribbon, an underlying layer ink ribbon, a light-shielding layer ink including light-shielding layer ink which is metallic ink, and a plurality of heating elements disposed in a row; and controlling means for controlling an operation of each of the image-formation ink ribbon, the underlying layer ink ribbon, the light-shielding layer ink ribbon, and the heating elements;

wherein the controlling means is constructed so that, at least during printing, first, the image-formation ink ribbon is selected, and, based on print information, the heating elements of the thermal head are selectively driven in order to thermally transfer image-formation ink of the image-formation ink ribbon within an image-formation area of a print medium, causing an image which is a mirror image formed with ink to be printed, after which, by selecting the underlying layer ink ribbon and driving the heating elements of the thermal head, underlying layer ink is thermally transferred onto a surface of the image on the print medium and at least a surface of a blank space section within the image-formation area of the print medium, causing the surface within the image-formation area of the print medium to be subjected to underlying layer printing in order to cover the surface within the image-formation area of the print medium with the underlying layer ink, after which, by selecting the light-shielding layer ink ribbon and driving the heating elements of the thermal head, light-shielding layer ink is thermally transferred onto the surface of the print medium that has been subjected to the underlying layer printing, causing the surface of the print medium that has been subjected to the underlying layer printing to be subjected to light-shielding layer printing in order to cover the surface of the print medium that has been subjected to the underlying layer printing with the light-shielding layer ink.

5. A printer comprising:

a thermal head including an image-formation ink ribbon, an underlying layer ink ribbon, a light-shielding layer ink ribbon, and a plurality of heating elements disposed in a row; and controlling means for controlling an operation of each of the image-formation ink ribbon, the underlying layer ink ribbon, the light-shielding layer ink ribbon, and the heating elements;

wherein the controlling means is constructed so that, at least during printing, first, the image-formation ink ribbon is selected, and, based on print information, the heating elements of the thermal head are selectively driven in order to thermally transfer image-formation ink of the image-formation ink ribbon within an image-formation area of a print medium, causing an image which is a mirror image formed with ink to be printed, after which, by selecting the underlying layer ink ribbon and driving the heating elements of the thermal head, underlying layer ink is thermally transferred onto a surface of the image on the print medium and at least a surface of a blank space section within the image-formation area of the print medium, causing the surface within the image-formation area of the print medium to be subjected to underlying layer printing in order to cover the surface within the image-formation area of the print medium with the underlying layer ink, after which, by selecting the light-shielding layer ink ribbon and driving the heating elements of the thermal head, light-shielding layer ink is thermally transferred onto the surface of the print medium that has been subjected to the underlying layer printing, causing the surface of the print medium that has been subjected to the underlying layer printing to be subjected to light-shielding layer printing in order to cover the surface of the print medium that has been subjected to the underlying layer printing with the light-shielding layer ink; and wherein a base having the same size as the print medium is peelably adhered to a back surface of the print medium, and one image-formation area surrounded by a half-cut section or a plurality of image-formation areas surrounded by corresponding half-cut sections are formed on the print medium, with the half-cut section and the half-cut sections extending from a front surface to the back surface of the print medium.

6. A printer comprising:

a thermal head including an image-formation ink ribbon, an underlying layer ink ribbon including white underlying layer ink, a light-shielding layer ink ribbon including light-shielding layer ink which is metallic ink; and a plurality of heating elements disposed in a row; and controlling means for controlling an operation of each of the image-formation ink ribbon, the underlying layer ink ribbon, the light-shielding layer ink ribbon, and the heating elements;

wherein the melt viscosity at 160° C. of the underlying layer ink of the underlying layer ink ribbon is lower than the melt viscosity at 160° C. of the image formation ink of the image-formation ink ribbon used to form an image with ink; and wherein the controlling means is constructed so that, at least during printing, first, the image-formation ink ribbon is selected, and, based on print information, the heating elements of the thermal head are selectively driven in order to thermally transfer the image-formation ink of the image-formation ink ribbon within an image-formation area of a print medium which is a transparent film or a transparent sheet, causing the image which is a mirror image formed with ink to be printed, after which, by selecting the underlying layer ink ribbon and driving the heating elements of the thermal head, the underlying layer ink is thermally transferred onto a surface of the image on the print medium and at least a surface of a blank space section within the image-formation area of the print medium, causing the surface within the image-formation area of the print medium to be subjected to underlying layer printing in order to cover the surface within the image-formation area of the print medium with the underlying layer ink, after which, by selecting the light-shielding layer ink ribbon and driving the heating elements of the thermal head, the light-shielding layer ink is thermally transferred onto the surface of the print medium that has been subjected to the underlying layer printing, causing the surface of the print medium that has been subjected to the underlying layer printing to be subjected to light-shielding layer printing in order to cover the surface of the print medium that has been subjected to the underlying layer printing with the light-shielding layer ink.

7. The printer according to claim 6, wherein the light shielding layer ink of the light-shielding layer ink ribbon is metallic ink.

8. The printer according to claim 6, wherein a base having the same size as the print medium is peelably adhered to a back surface of the print medium, and one image-formation area surrounded by a half-cut section or a plurality of image-formation areas surrounded by corresponding half-cut sections are formed on the print medium, with the half-cut section and the half-cut sections extending from a front surface to the back surface of the print medium.

* * * * *